US011259581B2

(12) United States Patent
Saladino

(10) Patent No.: US 11,259,581 B2
(45) Date of Patent: Mar. 1, 2022

(54) APPAREL WITH RETRACTABLE EXTENSIONS

(71) Applicant: GOOD.B, LLC, Cardiff-by-the-Sea, CA (US)

(72) Inventor: Gregory J. Saladino, Cardiff by the Sea, CA (US)

(73) Assignee: GOOD.B. LLC

( * ) Notice: Subject to any disclaimer, the term of this patent is extended or adjusted under 35 U.S.C. 154(b) by 290 days.

(21) Appl. No.: 16/297,046

(22) Filed: Mar. 8, 2019

(65) Prior Publication Data

US 2019/0200692 A1 Jul. 4, 2019

Related U.S. Application Data

(63) Continuation of application No. 14/452,380, filed on Aug. 5, 2014, now Pat. No. 10,226,086, which is a continuation-in-part of application No. 13/507,389, filed on Jun. 25, 2012, now Pat. No. 9,364,040.

(60) Provisional application No. 61/862,145, filed on Aug. 5, 2013.

(51) Int. Cl.
*A41D 15/00* (2006.01)
*A42B 1/206* (2021.01)

(52) U.S. Cl.
CPC ..... *A41D 15/002* (2013.01); *A42B 1/206* (2013.01); *A41D 2200/20* (2013.01)

(58) Field of Classification Search
CPC ... A41D 15/002; A41D 2200/20; A42B 1/048
USPC ..... 2/69, 181
See application file for complete search history.

(56) References Cited

U.S. PATENT DOCUMENTS 2,615,168 A 10/1952 Tannenbaum
2,839,757 A * 6/1958 Salvatore ..... A42B 1/045 2/205
3,750,192 A 8/1973 Beresic
3,765,031 A 10/1973 Beresic
4,302,850 A 12/1981 Maeshima
RE30,899 E 4/1982 Kallman
4,689,831 A 9/1987 Greenberger et al.
4,773,101 A 9/1988 Kapp et al.
5,062,163 A 11/1991 Avey
5,105,475 A 4/1992 Lynd et al.
5,369,809 A * 12/1994 Hall ..... A41D 3/00 2/202
5,473,778 A 12/1995 Bell
5,539,929 A 7/1996 Revson
(Continued)

FOREIGN PATENT DOCUMENTS

KR 20-0239252 Y1 10/2001

OTHER PUBLICATIONS

International Search Report issued in International Application No. PCT/US2013/047160, dated Oct. 4, 2013.
(Continued)

*Primary Examiner* — Timothy K Trieu
(74) *Attorney, Agent, or Firm* — Manuel de la Cerra

(57) ABSTRACT

Apparel in which retractable extensions from a body portion can be selectively engaged to cover the wearer's face, head, arms or legs. The extension of material is connected to the body portion, and stored within a pocket when it is not in use. When it is needed, the wearer reaches into the pocket, and extends the material out of the pocket, engaging it as a useful sleeve, pant leg, face covering, or hood.

16 Claims, 21 Drawing Sheets

(56) References Cited

U.S. PATENT DOCUMENTS

| | | | | |
|---|---|---|---|---|
| 5,713,077 | A * | 2/1998 | Humbrecht | A42B 1/045 2/173 |
| 5,794,276 | A | 8/1998 | Walker | |
| 5,815,832 | A | 10/1998 | Skolik | |
| 5,860,165 | A | 1/1999 | Cvijanovich | |
| 5,894,604 | A | 4/1999 | Crabb et al. | |
| 5,926,854 | A | 7/1999 | Grilliot et al. | |
| 5,933,871 | A | 8/1999 | Kraft | |
| 6,170,087 | B1 | 1/2001 | Brannon | |
| 6,370,692 | B1 * | 4/2002 | Duyn | A41D 3/02 2/86 |
| 7,240,372 | B2 | 7/2007 | Larson | |
| 7,260,850 | B2 | 8/2007 | Ambuske et al. | |
| 7,690,052 | B2 | 4/2010 | Saladino | |
| 8,001,624 | B1 | 8/2011 | Leedom | |
| 9,364,040 | B2 | 6/2016 | Saladino | |
| 9,512,873 | B2 | 12/2016 | Oguma et al. | |
| 9,521,873 | B1 | 12/2016 | Mignone | |
| 2002/0100106 | A1 | 8/2002 | Simmons | |
| 2006/0117450 | A1 | 6/2006 | Matsumoto | |
| 2008/0250538 | A1 | 10/2008 | Saladino | |
| 2009/0019616 | A1 | 1/2009 | Smith et al. | |
| 2009/0210995 | A1 | 8/2009 | Kwon et al. | |
| 2011/0185482 | A1 * | 8/2011 | Godfrey | A41D 23/00 2/424 |
| 2011/0252547 | A1 | 10/2011 | Leung et al. | |
| 2012/0060259 | A1 | 3/2012 | Falken | |
| 2013/0340142 | A1 | 12/2013 | Saladino | |
| 2014/0345029 | A1 | 11/2014 | Saladino | |
| 2015/0223527 | A1 | 8/2015 | Arora et al. | |
| 2016/0015099 | A1 | 1/2016 | Saladino | |

OTHER PUBLICATIONS

Frostline Hat™ Style #82045OR. 3 pages. Website: http://www.outdoorresearch.com/en/frostline-hat.html. [Retrieved Oct. 2, 2014].

* cited by examiner

APPAREL WITH RETRACTABLE EXTENSIONS

CROSS-REFERENCE TO RELATED APPLICATIONS

This application claims priority to and is a continuation of a U.S. patent application Ser. No. 14/452,380 to Saladino, filed Aug. 5, 2014, and entitled "Apparel with Retractable Extensions," now U.S. Pat. No. 10,226,086, issued Mar. 12, 2019, which claims priority to and is a continuation-in-part application of U.S. patent application Ser. No. 13/507,389 to Saladino, entitled "Headwear With Storable Accessory," filed Jun. 25, 2012, now U.S. Pat. No. 9,364,040, issued Jun. 14, 2016; and claims priority to U.S. Provisional Patent Application Ser. No. 61/862,145, entitled "Apparel With Retractable Extensions," filed Aug. 5, 2013. The disclosures of the aforementioned applications are hereby incorporated by reference, each in its entirety.

FIELD OF THE INVENTION

The methods, apparatus, and systems described herein relate generally to an article of apparel, and more specifically to an article of apparel in which a retractable extension from a body portion can be selectively utilized to cover the wearer's face, head, arms, or legs.

The present invention relates generally to headwear, and more particularly to an article of headwear such as a cap, hat, hood or helmet, and an accessory, such as a goggle or bandanna, stored in the headwear and selectively moved into a position over the wearer's face.

BACKGROUND OF THE INVENTION

It is typical, that when wearing outerwear, the user would prefer to have the choice of removing portions of his clothing, or adding portions, depending on the weather or the time or day. For example, in the early morning, he may leave the house with a full jacket, where the sleeves are present. As the day goes on, and the sun shines brighter and the heat rises, he may prefer to not have sleeves. In typical designs, it is common practice to un-zip or unbutton the sleeves from a main body portion. The wearer then has to store the sleeves somewhere not on the main body, making it quite common for the wearer to lose the sleeves. As the day goes on, he may begin to get cold again. He therefore has to find where he put the sleeves, and reattach the sleeves to the main body portion. It is typical that the reattaching of the sleeves by buttoning or zipping them to the body can be difficult, time consuming, and frustrating. The zippers or the button snaps have to line up exactly, taking more than a few minutes. The same scenario is relevant to the use of pants with removable legs, jackets with removable hoods, or hoods with removable bandannas.

It is an object of the methods, apparatus, and systems described herein to provide a jacket or shirt that has retractable sleeves, which, when retracted, remain in a storage region within the main body of the article of apparel.

It is also an object of the methods, apparatus, and systems described herein to provide an item of headwear that has a retractable face covering, which, when retracted, remains in a storage region within the main body of the headwear.

It is further an object of the methods, apparatus, and systems described herein to provide a jacket that has a retractable hood, which, when retracted, also remains in a storage region within the main jacket.

It is yet a further object of the methods, apparatus, and systems described herein, to provide shorts that have a retractable pant leg, which, when retracted, remain in a storage region within the main body of the shorts.

SUMMARY OF THE INVENTION

To these ends, the methods, apparatus, and systems described herein are directed to items of apparel in which an extension of material from a main body is stored in a first position where it remains in a storage region. It is then placed in a second open position, where the excess material of the main article is used as an extension of the main body. A retention mechanism is attached to the extension of material and then is passed through a region in the main body portion, so that when the retention mechanism is pulled through the area of the main body portion, the extended material moves from its second open position back to its first stored position within the storage region.

The main body portion may consist of a hood or a hat with an extended face covering. It may consist of shorts and extended material in the form of pant legs. It may also be in the form of a jacket or shirt, wherein the extension extends from the neck area up and over one's head to form a hood. In another aspect of the articles of apparel described herein, the main body portion may be a vest, wherein the extended material is present in the form of sleeves that extend from the storage region and cover one's arms, forming a full jacket.

In some embodiments, an article of apparel is provided that includes a body portion having a storage region and an extension normally positioned in a first, open position and a retention means operably secured to said extension and being effective when manually pulled to move said extension from its said first position to a second, storage position within said storage region. The article of apparel may include embodiments in which the body portion is an article of headwear. Additionally, or alternatively, the article of apparel may include embodiments in which the retention means include a string.

In a related aspect, an article of apparel is provided in some embodiments that may include a body portion having a storage region formed therein and an extension normally positioned in a first, open position, and a retention means operably secured to said extension and passing through a region of said body portion, said retention means being effective when manually pulled to move said extension from its said first position to a second position within said storage region.

The following features may be present in the article of apparel in any suitable combination. The body portion may be an article of headwear, and said extension is a face covering in some embodiments. In such embodiments, the headwear may be a hood. The retention means may include a string attached to an end of said extension. Alternatively, or additionally, the retention means may include a band that can be transformed into a string. In some embodiments, the article may be a jacket, and said extension is a sleeve. In some other embodiments, the article may be a pair of shorts, and said extension is a pant leg.

In some embodiments, the invention may comprise headwear having a storage region and extension normally stored in a first stored position within said storage region, and a retention means operably secured to said extension for moving, when manually engaged, said extension from its said first position to a second, engaged position across the wearer's face, and a means provided for separably attaching said extension at a location on an alternate side of the headwear may be provided.

Further, in some embodiments, a jacket having a storage region, a hood normally stored in said storage region, and means operably secured to said hood to move, when manually engaged, said hood from its said first position to a second position over the wearer's head, and means provided for separably attaching said hood at a position on an alternate location on the jacket may be provided.

In another related aspect, an article of apparel may be provided in some embodiments having a storage region and an extension normally in a first, exposed position, with the said extension having a normally secured opening through which an appendage passes, and manually operable means operably secured to said extension for moving said extension from its said first position to a second, stored position within said storage region. In such embodiments, the extension may include a sleeve of a jacket or shirt. Conversely, or additionally, the extension may be a pant leg of a pair of shorts.

Another related aspect may be provided in some embodiments in which an article of apparel may have a body, a storage region formed in said body, and an extension normally positioned in a first, exposed position and a normally secured opening that allows an appendage of said wearer to pass through said opening, and a manually operable retention means operably secured to said appendage for moving said extension from its said first position to a second storage position within said storage region, said retention means passing through a second opening in said body. In such embodiments, the extension may include a sleeve of a jacket or shirt. Conversely, or additionally, the extension may be a pant leg of a pair of shorts. The extension may be a mask extending from an item of headwear in some such embodiments. Alternatively, or additionally, the extension may be a hood extending from a jacket.

In some embodiments, an article of apparel may be provided that has a storage region and an extension stored in a first position within said storage region, and means operably secured to said extension for moving said extension to a second exposed external to the article and for then returning said extension to its said first position by manually grabbing said extension from inside the article. In such embodiments, the extension may include a sleeve of a jacket or shirt. Conversely, or additionally, the extension may be a pant leg of a pair of shorts.

Provided in some embodiments may be a self-storing pocket on an article of clothing having a main body portion, said pocket being formed when a retention mechanism operably secured to an extension of material extending from said main body portion is moved through an area on said main body portion, thereby causing said extension to fold into itself. In such embodiments, the extension may be a mask extending from an item of headwear. The extension may be a hood extending from a jacket; the extension may be a sleeve extending from a jacket. In some embodiments, the extension may be a pant leg extending from a pair of shorts.

It is therefore an object of the present invention to provide an item of headwear and an associated accessory in which the accessory can be readily placed in position for use when desired and returned to its original, stored position after its use.

It is another object of the invention to provide an item of headwear as described, in which the accessory may be easily adjusted over the wearer's face so as to achieve an improved fit and snugness.

It is yet a further object of the invention to provide an item of headwear as described in which the accessory is securely retained in the headwear when not in use in a manner that does not materially change the overall appearance of the headwear.

It is yet a further object of the invention to provide an item of headwear in which fogging of an eyewear lens or goggle during use is substantially prevented.

To these ends, the present invention is directed to an item of headwear and an accessory in which an accessory-storage area or pocket is provided on one side of the hat and in which the accessory is stored when it is not in use. When it is desired to deploy the accessory for use in protecting the wearer's face, the wearer grasps the free end of the accessory, pulls it out and away from its stored position and across his face, and then detachably secures the free end of the accessory to the opposite side of the hat. The wearer may adjust the tightness and fit of the accessory to optimally conform it to the size and shape of his face.

The accessory used with the headwear of the invention may be a goggle band, ski goggle, or bandanna. The accessory may be used, for example, in conjunction with the hood of a hooded sweatshirt, the hood of a jacket, a hat, a cap or a helmet.

In another aspect of the present invention, the headwear may include a non-permeable layer to prevent heat and moisture from the wearer from passing onto the lens of the adjacent goggle when it is in its rest or stored position, so that the lens is not fogged and the wearer's vision is not impaired when the goggle is in place over the wearer's eyes.

BRIEF DESCRIPTION OF THE DRAWINGS

To the accomplishment of the above and to such further objects as may hereinafter appear, the methods, apparatus, and systems described herein relate to an article of apparel and an associated extension of the article, substantially as defined in the appended claims and as described in the following specification of several embodiments as considered in conjunction with the accompanying drawings, in which:

DETAILED DESCRIPTION OF PREFERRED EMBODIMENTS

Figure 1:
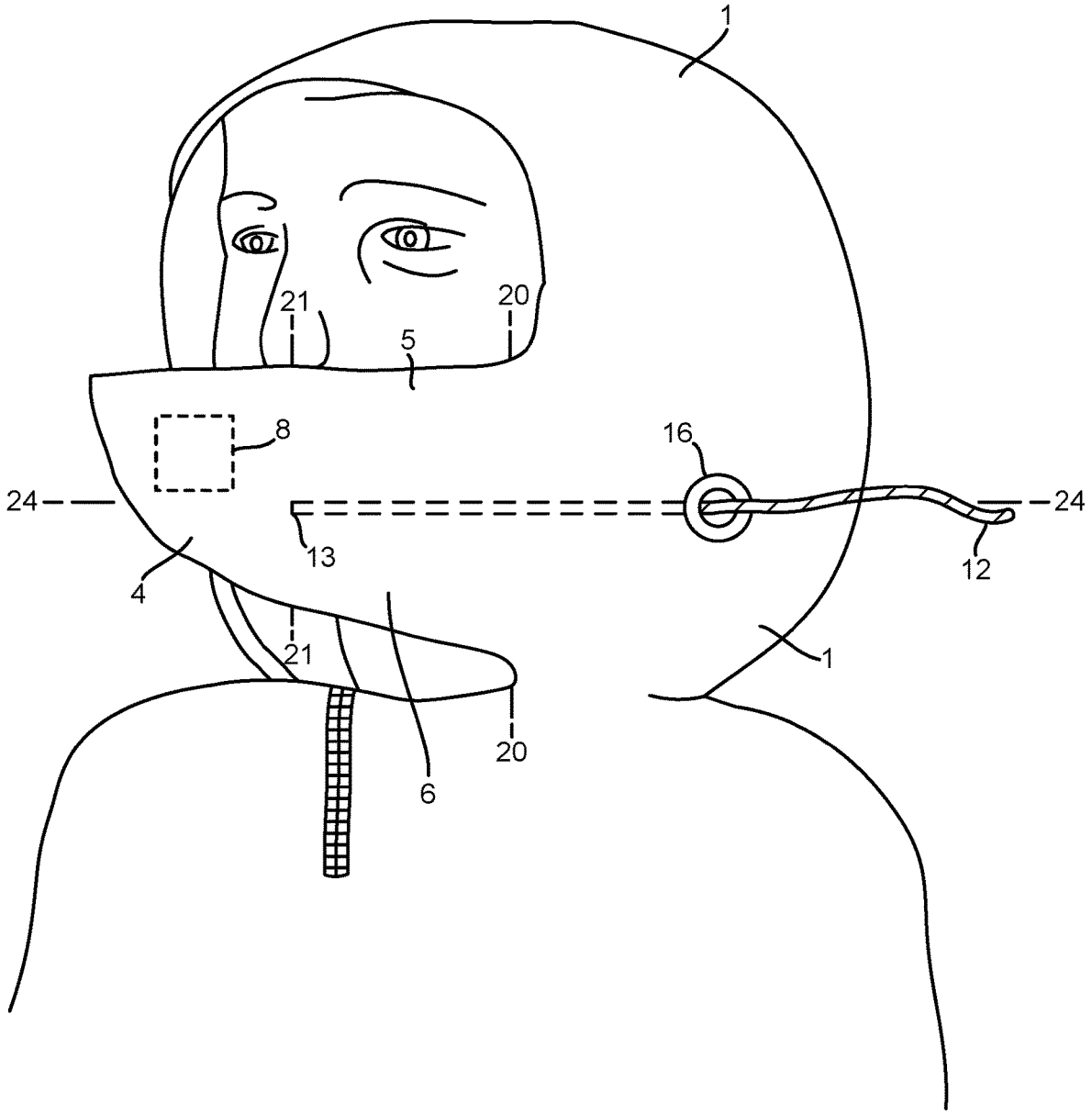
FIGS. 1-4 illustrate a side elevation of an embodiment of an item of headwear and its extended material.
Figure 2:
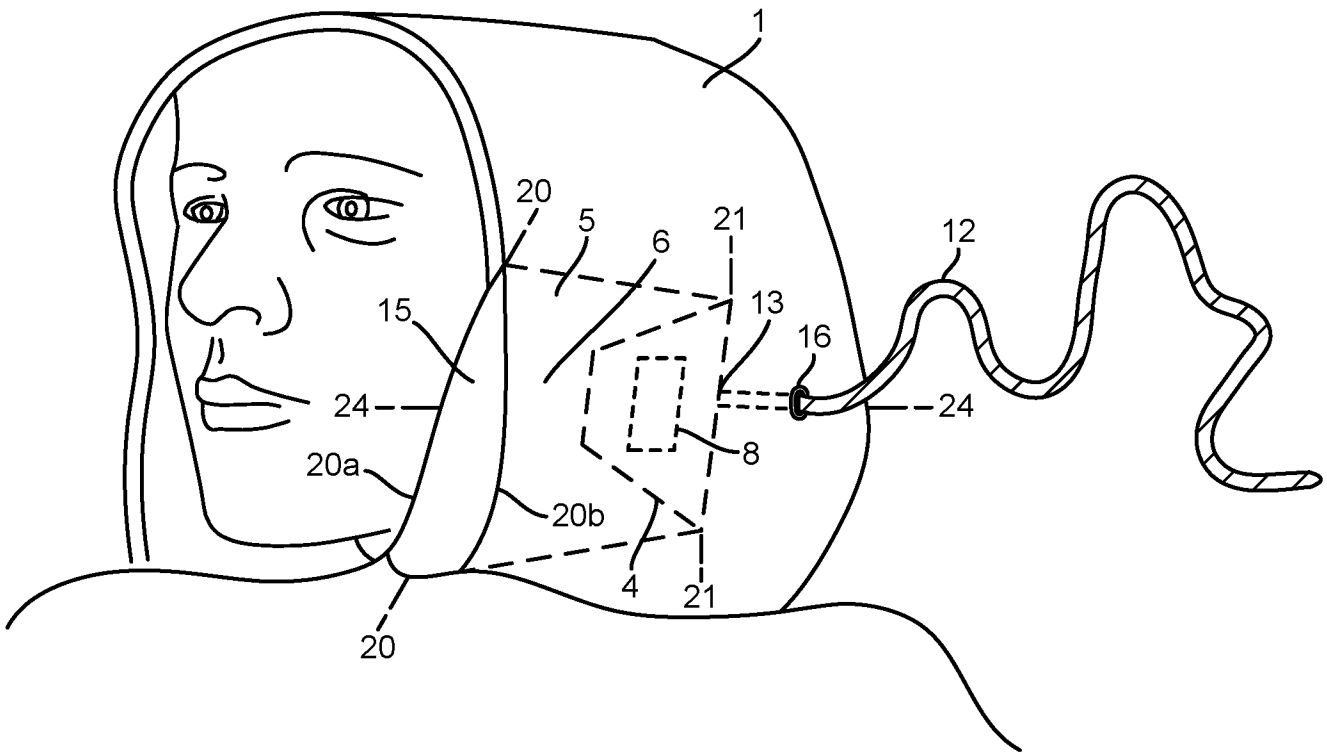
Figure 3:
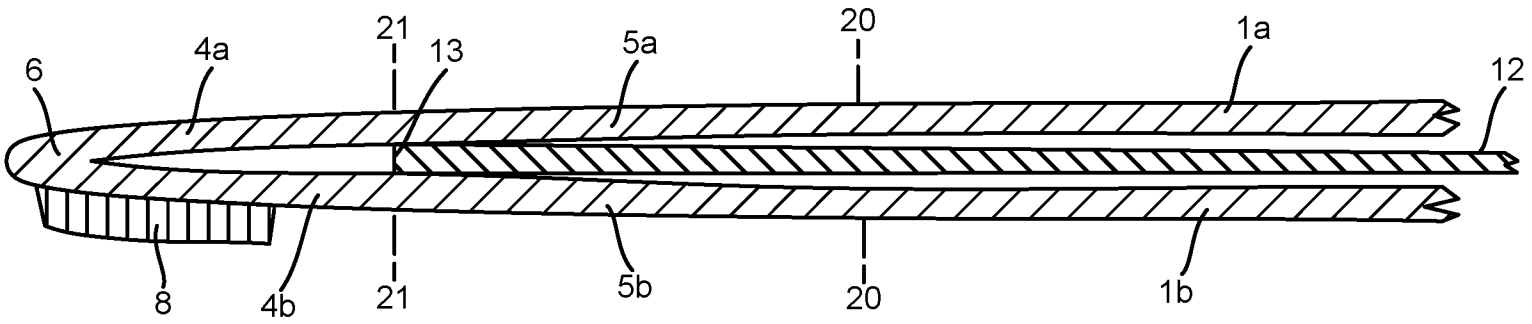
Figure 4:
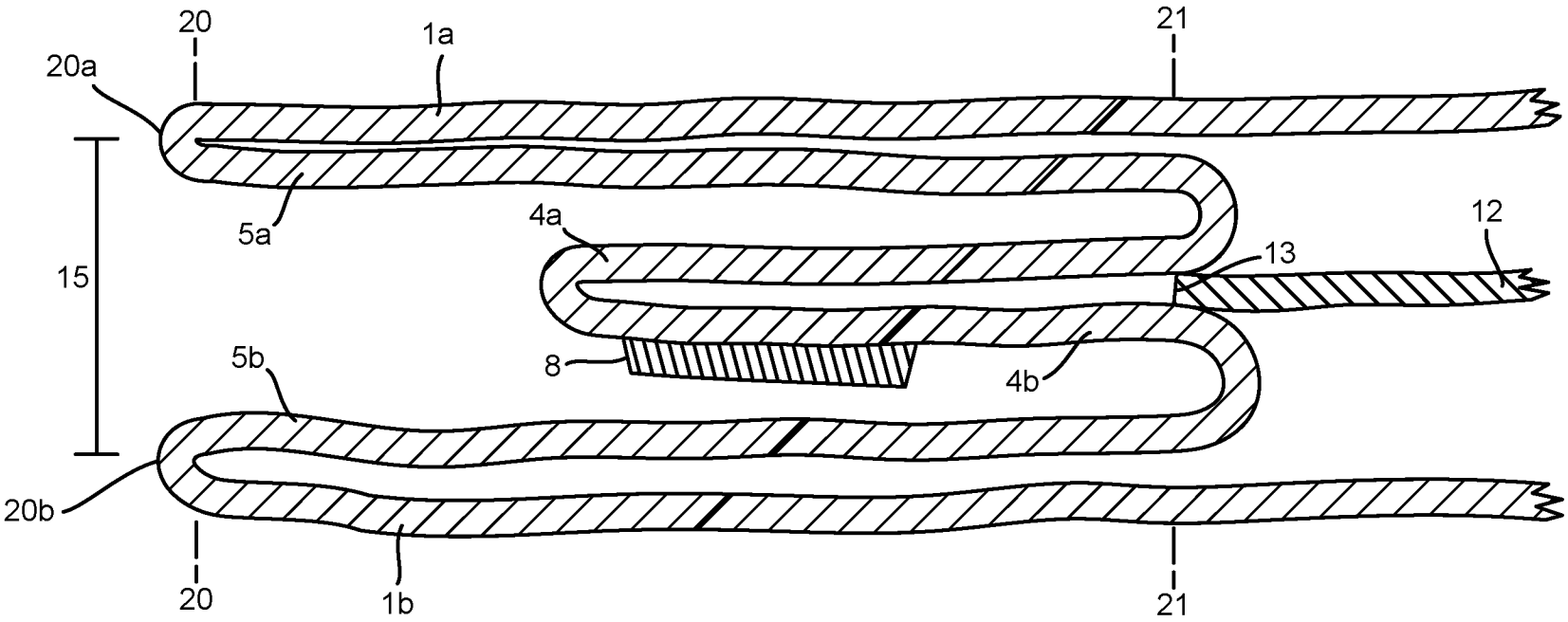

Referring now to the drawings, there is shown in FIGS. 1-4 a first embodiment of an article of apparel that is a hooded sweatshirt with a hood 1 and an extension of material 6 which has its origin stemming from hood 1 and extends outward and over the face, as seen in its first open position, as shown in FIG. 1. Extension area 6 and hood 1 are constructed of a dual layered material, as shown in FIGS. 3 and 4. Operably secured or attached between the dual layers of material 6 at a contact point 13 is retention mechanism 12, which passes through the dual layers of extended material 6, then through the dual layers of hood 1, and then exits headwear 1, through grommet 16. Grommet 16 may be situated at any position on headwear 1. Grommet 16 may also be situated in a pocket of the hooded sweatshirt, so that the retention mechanism 12 passes through the hood 1, where it travels through the body of the sweatshirt and exits through the pocket. It is also possible that the dual layers of extension material 6 may be attached to a separate container or to a capsule that can be attached to a helmet, or to an item of headwear such as a winter hat.

Contact Point 13 divides up the extended material 6 into two parts, an outer area 4 and an inner area 5, by means of area 21. Here the retention mechanism is a string. It is possible that the retention mechanism may also be a strap or a band. It is also possible that the retention mechanism may begin as a strap, and continue into a string.

Attached to the inner area of extension area 4 is a Velcro® tab 8, which when material 6 is extended across the face, attaches to an alternate Velcro® tab positioned either internally or externally to headwear 1, on the opposite side of headwear 1 (not shown). Velcro® tab 8 may also be attached to the outer area of extension area 4. As used herein, Velcro® may refer to hook and loop fasteners or components of those types of fasteners.

In use, as shown in FIG. 2, the wearer detaches the Velcro® tab 8 from its alternate attaching means on the opposite side of headwear 1, then grabs the retention mechanism 12 and pulls it out and away from his head through the grommet 16, causing the extended material 6 along area 20 to fold inside the hood, forming a natural pocket 15.

Inside of the pocket 15, extended material 6 is prevented from folding or from being pulled further inward past area 21, as the contact point 13 is not allowed to be pulled further into the hood as the length of material at area 5 and its connection to the material of hood 1 at area 20 prevents it, thereby leaving the excess material 4, which houses the Velcro® tab 8, to rest inside the pocket 15 in a stable and stored position. It is also possible, when the extended material 6 is retracted the into hood 1, for the Velcro® tab 8 to attach itself to an alternate attaching means situated externally to the natural pocket 15.

When it is desired to have the extended material 6 cover one's face, the wearer reaches inside the pocket 15, grabs the material 4 and pulls it out of the pocket 15, unfolding and extending it over his face, and then reattaches the Velcro® tab 8 to the alternate side of his headwear at a cooperating means, as is shown in FIG. 1.

It is also possible to have the material 6 fold on the area 20 and remain inside the hood, whereas retention mechanism 12 would then be connected to an area external to the extension material 6. It would then pass through an area or an external loop situated on the inside of the headwear 1. In this case, it is also possible to have a pocket built into the inside of headwear 1, so that the material 6, when folded inside of the headwear 1, will rest more securely in place.

It is also possible that the natural pocket 15 may be positioned inward from the frontal opening of hood 6.

FIG. 3, which depicts a cross-section across the line 24 shown in FIG. 2, shows the material 6 extended outwardly in front of the face and how it is connected to the headwear 1, which begins after the fold area 20. Retention mechanism 12 is attached at a contact point 13 between the dual layers of material 6 at area 21 by means of the contact point 13, forming areas 4 and 5 of the extended material 6. Material area 4 is now split into layers 4*a* and 4*b*, material 5 is now divided into layers 5*a* and 5*b*, and material 1 is now split into layers 1*a* and 1*b*. Material areas 1*a*, 5*a*, 4*a*, 4*b*, 5*b*, and 1*b* may exist as one continuous piece, formed from at least one piece of continuous material. This one-piece continuous construction of material may exist in all extensions mentioned herein.

FIG. 4 shows a cross-section 24 from FIG. 2, showing the extendable material 6 when it is folded along areas 20 and 21, and resting between the dual layers of headwear 1*a* and 1*b*, after the retention mechanism 12 has been pulled out and away from the hood through the grommet 16 (as seen in FIG. 2), which forms the pocket 15, designated by corners 20*b* and 20*a*. It is possible that a closure mechanism such as Velcro® or button snaps may be attached to the inner portion of the pocket 15 on the surface on areas of 5*a* and 5*b*, so that the pocket 15 may be selectively opened or closed. It is also possible that a stitch may be sewn through the material 5*a* and 1*a* or 5*b* and 1*b*, forming a natural channel, so that a string may pass through this channel, which can then be used to selectively tighten or loosen the fit of the hood 1.

Figure 5:
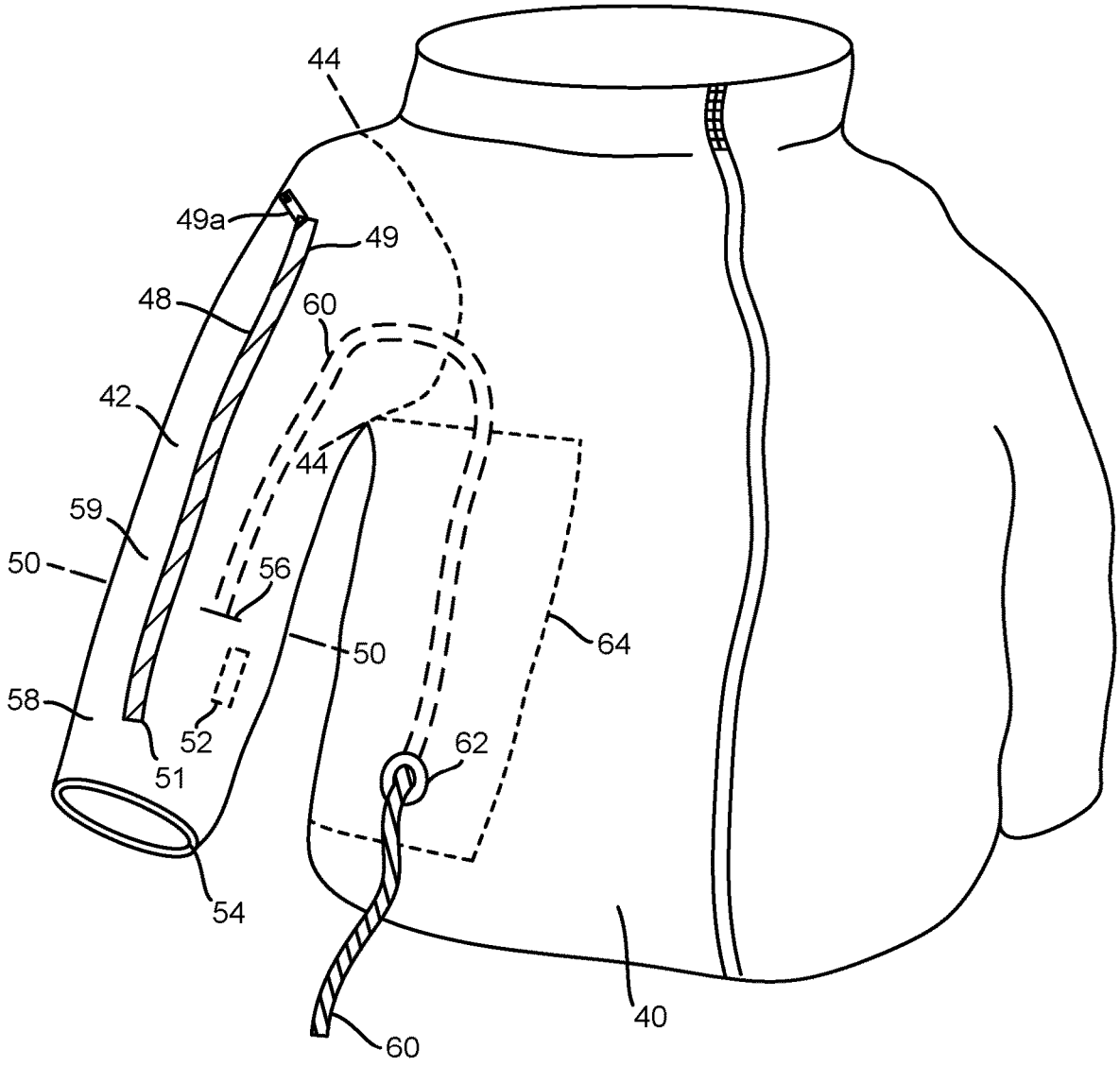
FIGS. 5-7 illustrate an embodiment of an article of apparel where the retractable extension is the sleeve of a jacket.
Figure 6:
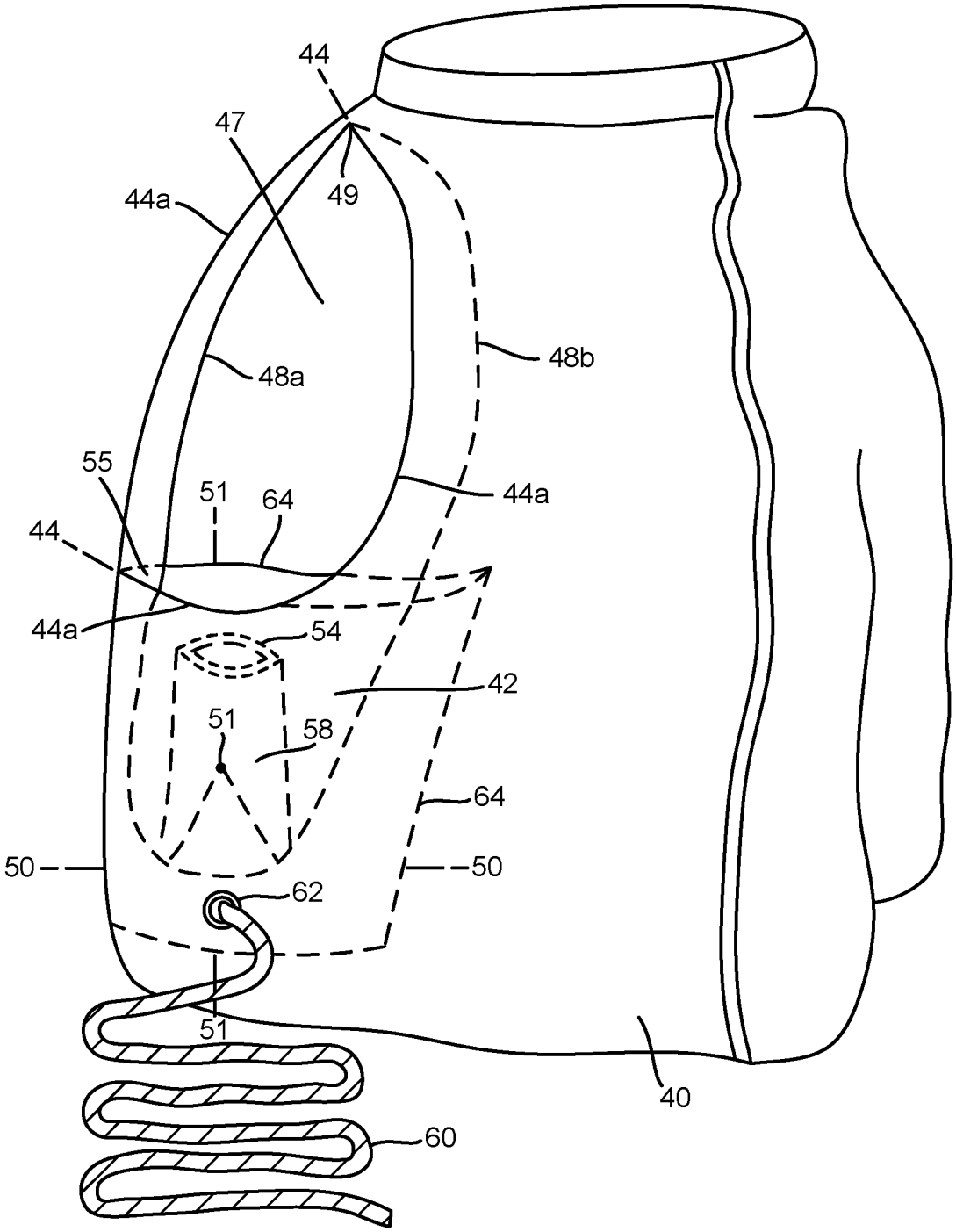

FIGS. 5 and 6 show the invention when it is utilized in the form of a jacket or a shirt 40. The shirt 40 has a full-length arm extension 59, which begins at the area 44. The arm 59 is divided by the area 50 into a lower portion 58 and an upper portion 42. The zipper pull 49*a* rests at the upper closed end of the zipper 49, which runs from the top portion of the sleeve 59 at an end point 49 and extends downwardly to the lower end of the sleeve 59 to an end point 51. The rounded cuff 54 designates the end of the sleeve 59, where the sleeve is open for a hand to fit through.

The retention mechanism 60 is operably secured to the inner surface of the sleeve 59 at a point 56, which also designates where the sleeve 59 divides into its two areas 58 and 42. Beginning at the contact point 56, a retention mechanism string 60 travels through the inside of the sleeve 59, passing up through the area 44, then down the right side of the jacket 40 and entering the top open side area of the pocket 64, and exiting the jacket 40 through the grommet 62. The grommet 62 and the pocket 64 may be situated at any position within the jacket 40. The bottom portion of the pocket 64 may be opened or closed, and the pocket 64 may be constructed of a mesh material, if desired, or of any fabric. A layer of material may be added within the sleeve 59, with both sides open to cover the exposed retention mechanism 60.

In use, with his left hand, the wearer reaches over to his sleeve 59, and grabs zipper pull 49*a*, and pulls it down from a point 49 to the point 51, thereby opening the sleeve. He then pulls his right hand up through an opening 54, and sticks it out of the open hole that is left open formed by the zipper 48 being opened. With his left hand, he now grabs hold of the retention mechanism 60 and pulls it out and away from the main body portion, thereby causing the sleeve 59 to be retracted into the jacket 40, whereby the sleeve 59 is now folded into itself and rests inside of the jacket 40 within the pocket 64, also forming a natural pocket 55, which lies inside of the pocket 64, as shown in FIG. 6. The lower portion of the sleeve 59, area 58, is now folded along the area 50. The sleeve 59 is now divided into two separate edges 48*a* and 48*b* tucked within the jacket 40, allowing the arm hole 47, now depicted by outer edge 44*a*, to form. The edge 44*a* is continuous around the arm hole 47. It is also possible that the edges 48*a* and 48*b* may be temporarily secured to the interior of jacket 40 by means of Velcro® or button snaps. In FIG. 6, the attachment point of the string 60 to sleeve 59 at the point 56 is not shown.

When the user desires to put the sleeve to use, with his left hand he reaches into his pocket 55, grabs hold of the sleeve 59 at its edge 54, and pulls the sleeve 59 out of the pocket 64 through the arm hole 47, thereby causing the string 60 to retract through the grommet 62 and once again extend itself within the jacket 40 along the inner area of the sleeve 59. When the sleeve 59 is outside of the jacket 40, the user then takes his right hand and slides it back through the hole 54, and then with his left hand he takes the zipper 49*a* and moves it upward from a point 51 to the point 49, thereby closing his right arm within the sleeve.

The tab 52 is situated on the lower portion of the sleeve 59, and may be used if the retention mechanism 60 were not present. In this case, after opening the zipper 48 with his opposite hand and sliding his arm through the opening, the wearer would then open the front zipper of the jacket 40 with his left hand and reach through the lower portion of the pocket 64 (now open), past area 44, and reach into the sleeve 59, grabbing hold of the tab 52, and then pull the tab 52 inside through the area 44 and into the pocket 64, where the sleeve would rest until needed. It is also possible that an opening may be situated on the lower portion of the area 44 around the armpit area of the jacket, and that the tab 52 would be positioned externally to the sleeve 59. In this case, from the interior of the jacket 40, the wearer would stick his arm through this opening, reach for the tab 52 on the outside of the sleeve 59, and pull the sleeve 59 into the interior of the jacket 40, where he would then manually fold it into the pocket 64. From the inside of his jacket 40, he may also reach through the bottom open portion of the pocket 64, then out through the opening at the armpit area, grab the external tab 52, and then pull it back into the pocket 64, thereby retracting the sleeve 59 into the pocket 64, where it would rest until needed. It is also possible to implement the two aforementioned embodiments into the other extensions and body portions mentioned herein.

Figure 7:
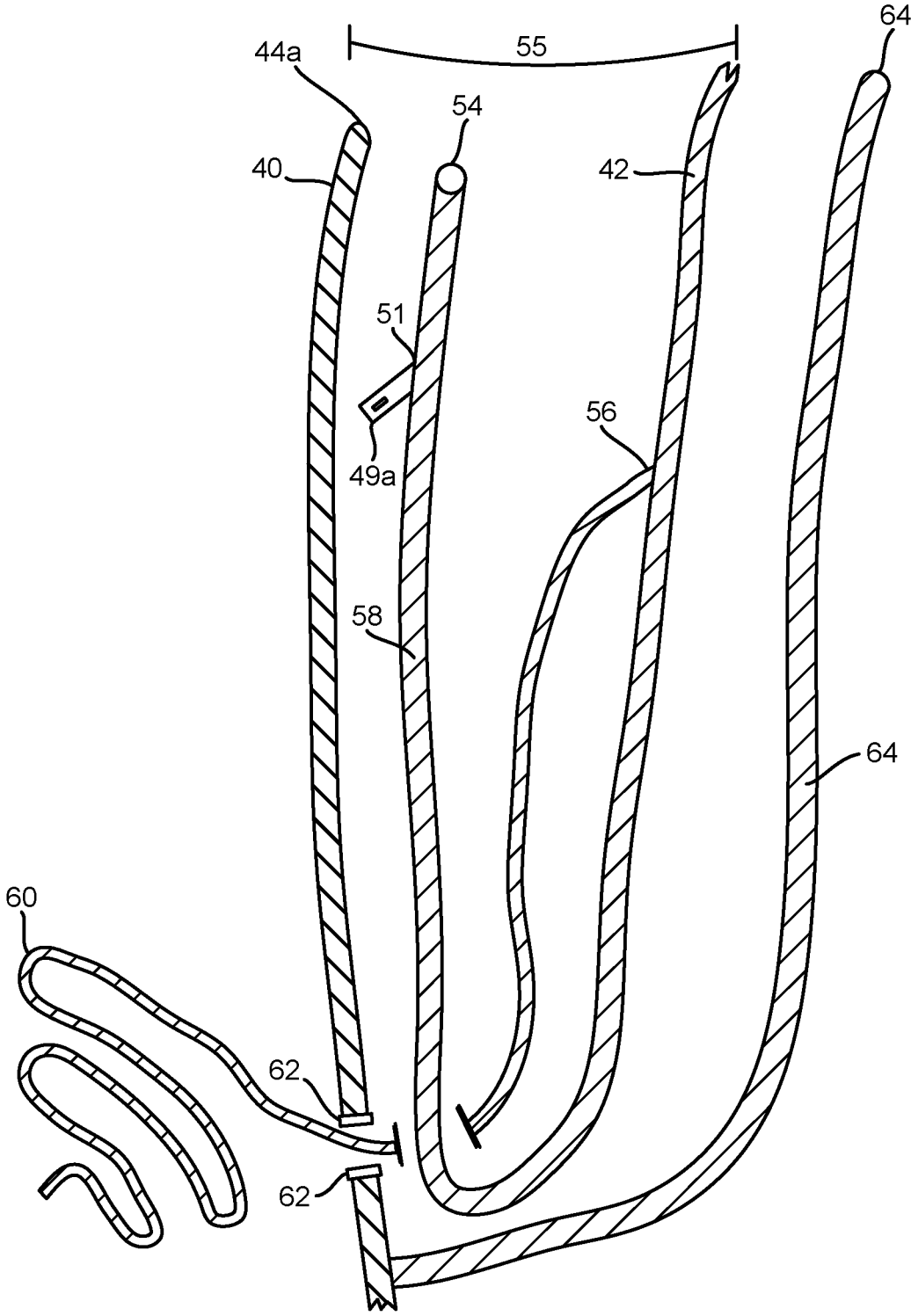

FIG. 7, which is a cross-section along the line 51 from FIG. 6, shows in further detail a naturally formed pocket 55 designated by a rounded edge 44*a* of the jacket 40 and an inner surface area 42, which houses the zipper 51, and the end of the sleeve 54. A retention string 60 is attached to the inner surface of the area 42 at a point 56, where it then passes through the opening in an area 58 (which is left open, as the zipper 48 is open), and then passes out of the jacket 40 by means of a grommet 62. A pocket 64 further houses the sleeve 59 as it is folded into its parts.

Regarding FIGS. 5-7, it is possible that the embodiment shown therein be situated in any position within the jacket 40. The zipper 48 may be situated at any position on the sleeve 59, and the retention mechanism 60 may be attached to any internal point within the sleeve 59. If the opening 48 were to be situated to the rear of the sleeve 59, then the sleeve 59, when opened and retracted into the jacket 40, would then be tucked into a self-made storable pocket, which would be situated on the upper frontal portion of the jacket 40.

Figure 8:
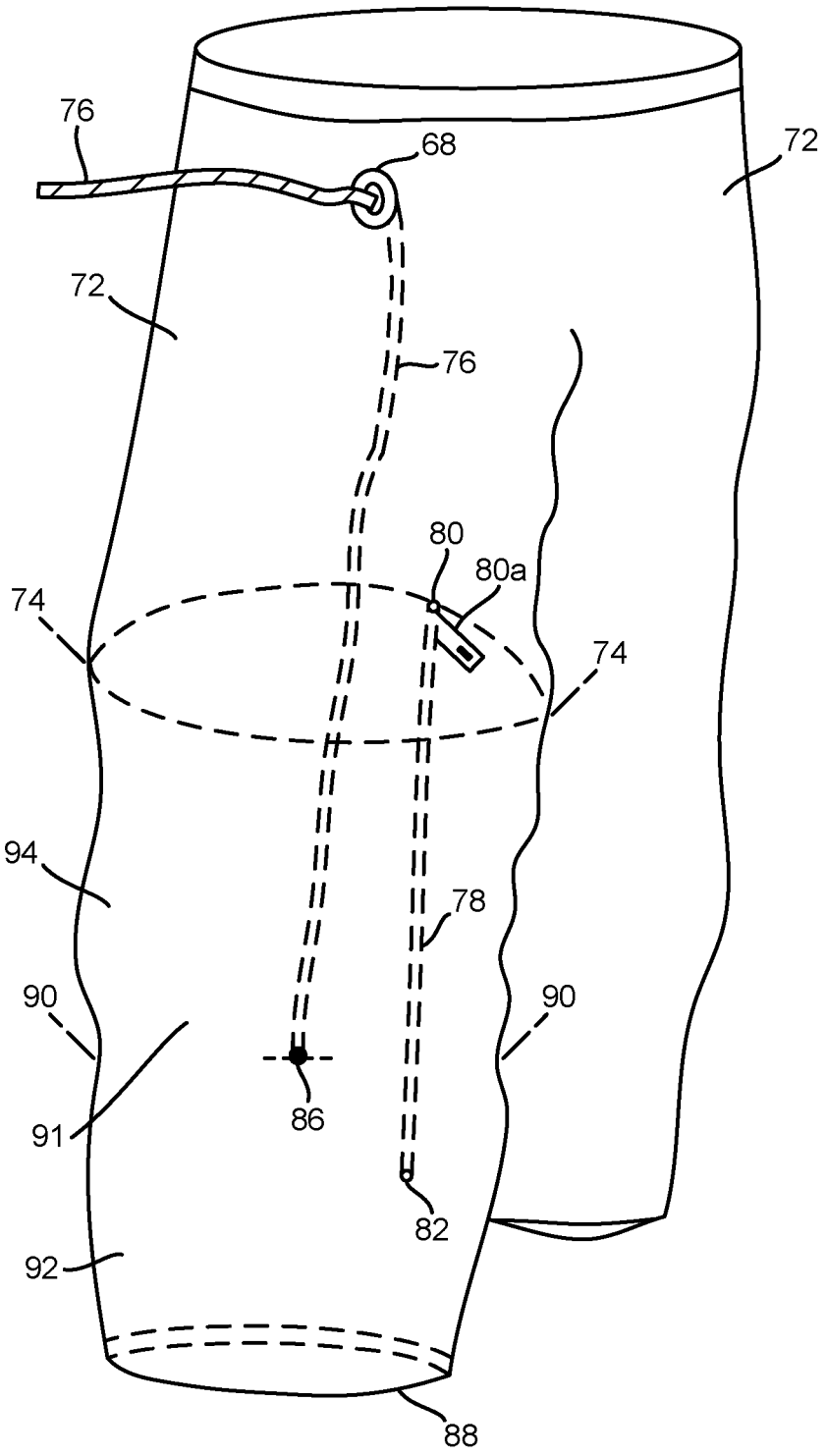
FIGS. 8 and 9 illustrate another embodiment of an article of apparel where the retractable extension is the lower portion of a pant leg.

FIG. 8 shows another embodiment of the invention in the form of a pant. Here is shown a main pant 72, which continues past the area 74 into a leg portion 91. The leg portion 91 is divided into the upper areas 94 and a lower leg area 92 by means of a horizontal area 90. The lower leg portion 92 ends by the cuff 88. On the inside of the leg portion 91 is a zipper closure 78 with a zipper pull 80*a* attached. The zipper 78 begins at a point 80 situated on a horizontal area 74 and travels down to a point 82. Also situated on the interior of and attached to the leg portion 91 at a point 86 is a retention mechanism 76, which passes up through the leg portion 91, then the area 74, then through the pant 72, and finally exits the pant 72 via means of a grommet 68.

Figure 9:
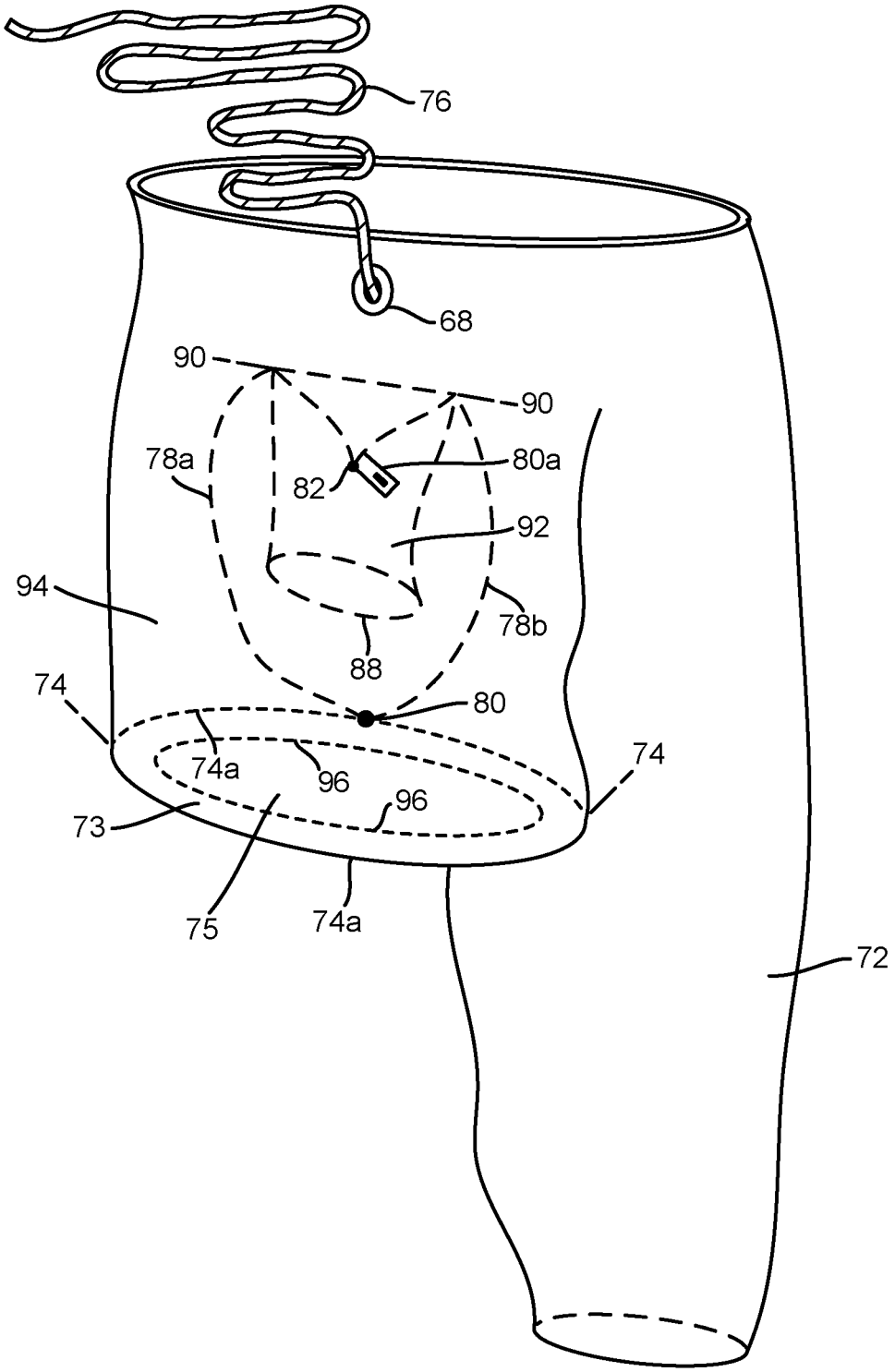

In use, and as seen in FIG. 9, the wearer unzips the zipper 78 into the edges 78*a* and 78*b* by grabbing the zipper pull 80*a* and sliding it down to the point 82. He then slides his right foot through the hole 88, so that it is external to the pant leg 91. He then, with his hand, takes hold of the retention mechanism 76 and pulls it out and away from his body, thereby causing the pant leg 94 to fold into itself at an area 74 as well as the area 90, creating a new outer edge of a pant leg 74*a* and a hole 75 through which the users' leg now is. The inner material 96 and the outer edge 74*a* create a pocket 73 where the pant leg 91 now rests. It is possible that an attaching means such as Velcro® or button snaps may be added to the inner surface of the material 96 and to the inner surface of the pant leg 72 close to the edge of 74*a* the material 96, so that when the pocket 73 is closed, the pant leg 91 will be secured within the pocket 73.

To extend the pant leg, the wearer reaches inside his pocket 73 and grabs the pant leg 91 by its edge 88 and pulls the pant leg 91 down so that it is fully extended, takes his foot and steps back into the pant leg 91 through the hole 88, and then he brings the zipper pull 80*a* from point 82 back up to point 80, completing the pant again. As the pant leg 91 is being dropped out of the pocket 73, the retention mechanism 76 is retracted back into the pant.

Figure 10:
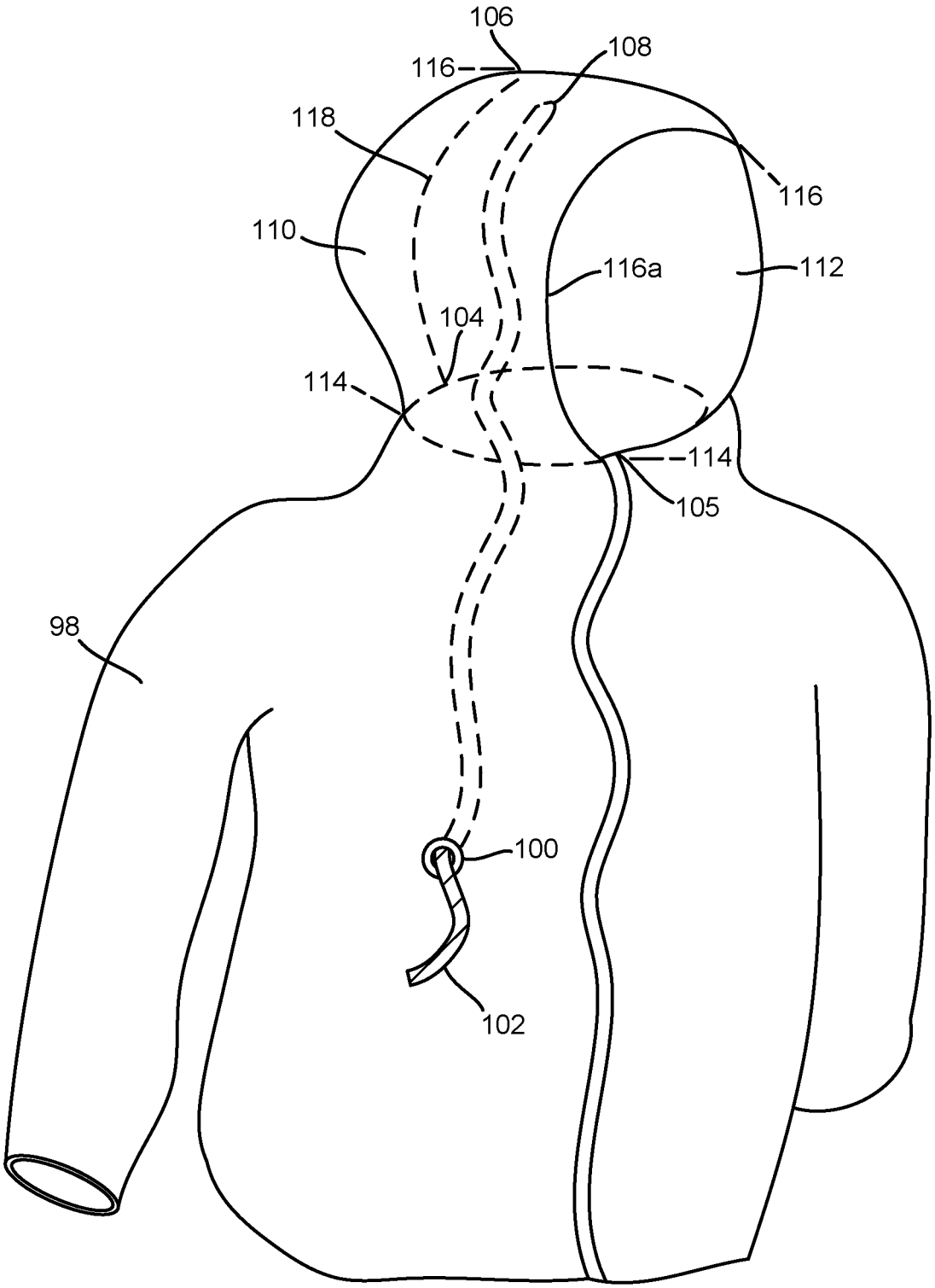
FIGS. 10-12 illustrate yet another embodiment of an article of apparel where the retractable extension is the hood of a jacket.

FIG. 10 shows another embodiment of the invention, wherein a hood 110 is attached to a main jacket 98. Both the hood 110 and the jacket 98 are made from dual-layered material. The retention mechanism 102 begins on the outside of jacket 98, travels through the grommet 100, through the inside of the dual layers of 98 up the chest portion past the neck at area 114, and then attaches itself to the hood 110 at a contact point 108 that is horizontally lined up with area 116. In the rear of the hood 110 is a slit 118 that is separably detachable from point 104 to point 106. An area 112 depicts an opening for the face.

On the far side of the area 114, beginning from the point 104 and stretching horizontally to the wearer's left to the point 105, the hood 110 is separably detachable from the main jacket 98 by means of Velcro®, magnets or the like.

In use, the wearer first opens the rear of the hood 110 by separating a slit 118 from points 104 to 106. He then takes the far side of the hood 110 from points 104 to 105 and separates the Velcro® tabs from the main jacket 98. Then he grabs the retention mechanism 102 and pulls it out and away from his body, thereby pulling the hood 110 into the body portion of the jacket 98, as seen in FIG. 11.

Figure 11:
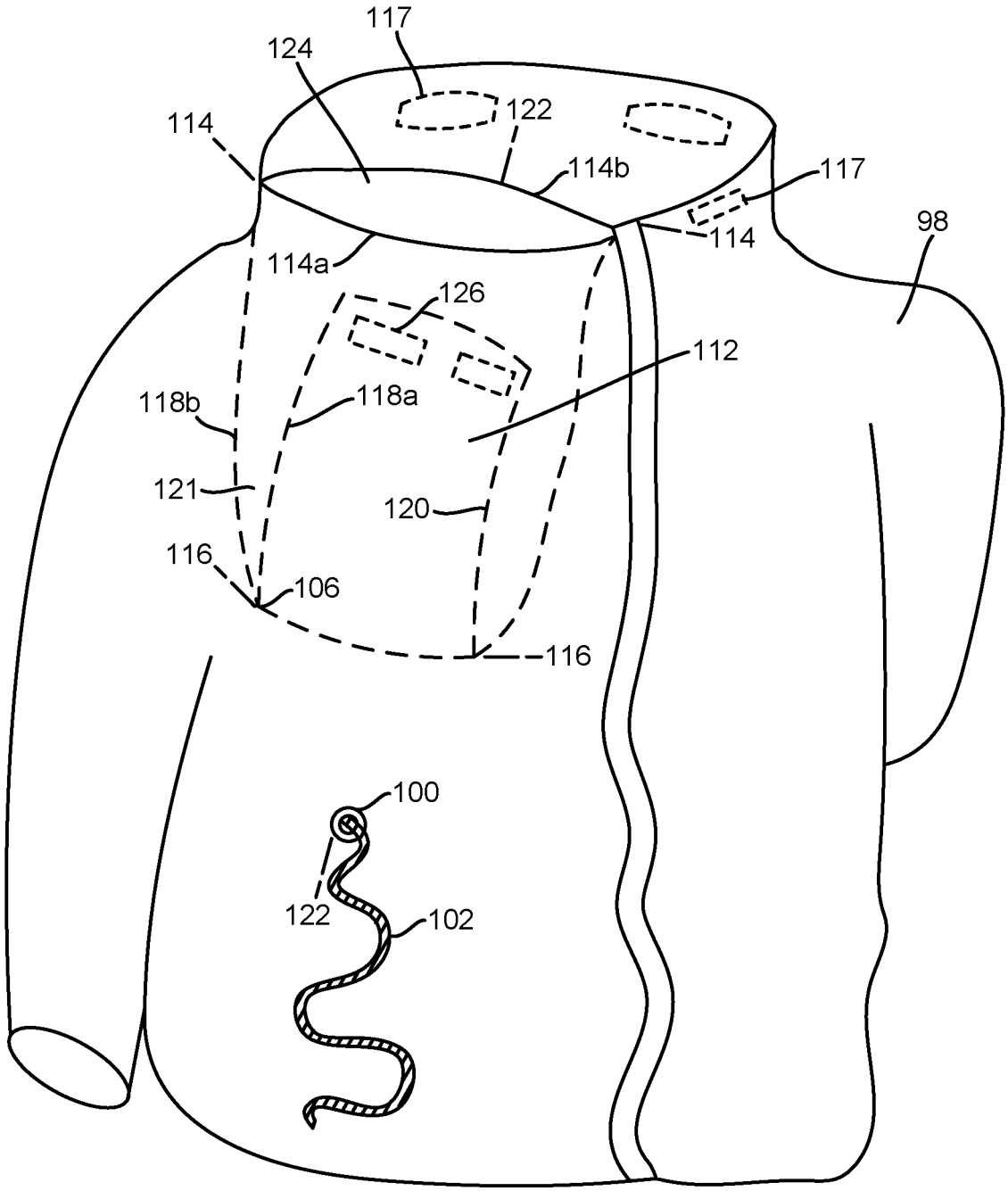

In FIG. 11 it is shown in more detail how the hood 110 is stored. The slit 118 has now divided into two separate edges 118*a* and 118*b*. The hood 110 has now also been divided into two portions 121 and 112 by fold area 116. The area 114 is now an opening 124, depicted by an inner layer 114*b* and an outer layer 114*a*. The attaching means 117 and its alternate attaching means 126 situated on the lower portion of the hood 110 are now depicted by an area 112 within the self-storable pocket 124.

Velcro® tabs 117 and 126 are separably detachable when the hood is exposed and in use. Therefore, in use, the wearer reaches into the hole 124, grabs the hood 110 at an area 112, pulls it out and over his head, and attaches Velcro® tabs 126 to the alternate Velcro® tabs 117. As he pulls the hood out of the pocket, a retention mechanism 102 retracts back into the main jacket 98 through a grommet 100. The user then reattaches edges 118*a* to 118*b* to once again form the seal of 118.

Figure 12:
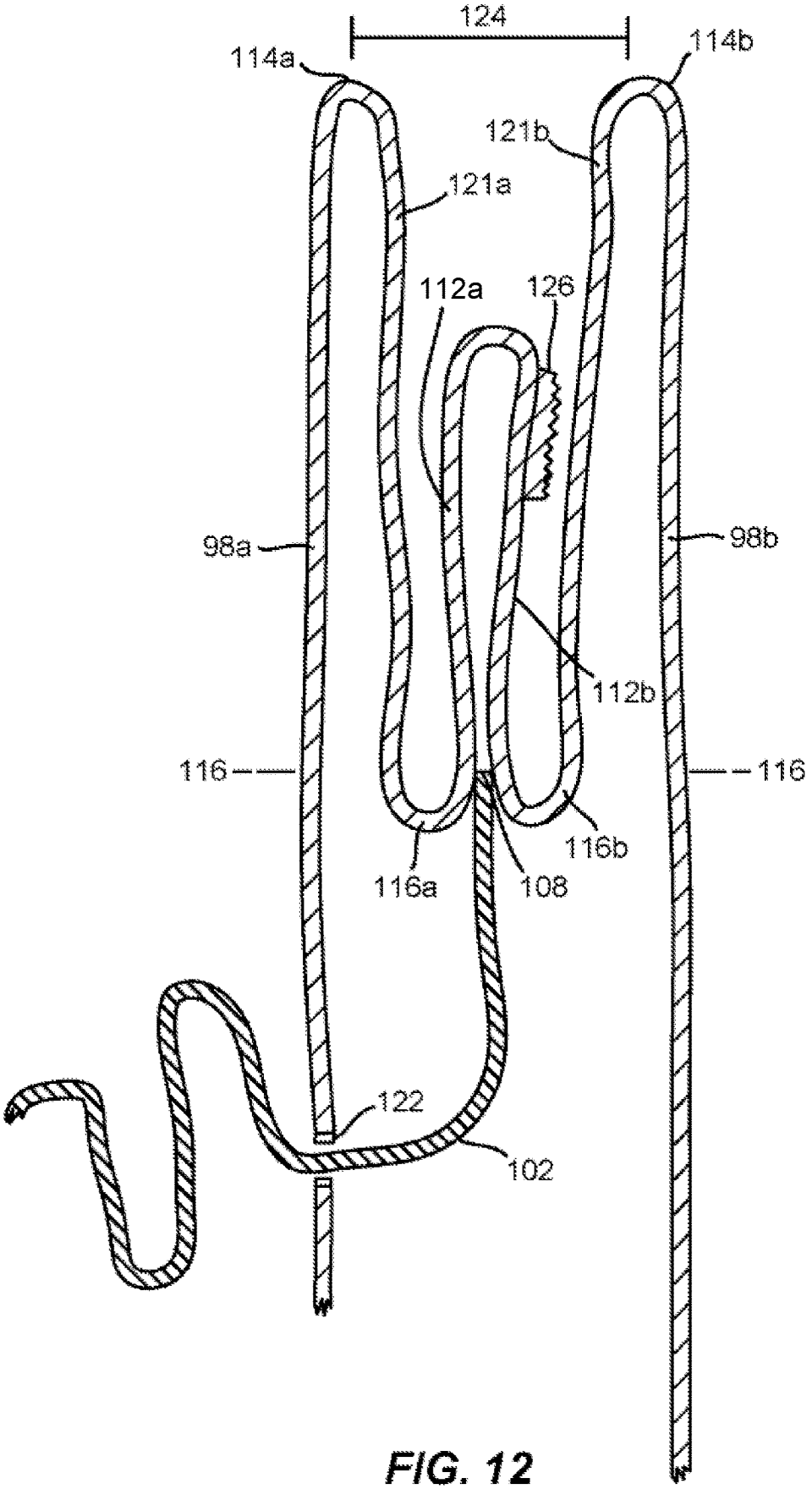

FIG. 12 shows a cross-section along line 122, as shown in FIG. 11. The dual layers of the jacket 98 are now depicted by an outer layer 98*a* and an inner layer 98*b*. The top rounded corners of 114*a* and 114*b* form a pocket 124 that houses a hood 110 when it is broken down into its two folded parts 112 and 121. The portions of hood 121 now create two layers 121*a* and 121*b*, which create a pocket for the dual layers 112*a* and 112*b* to rest between. A retention mechanism 102 attaches itself between layers 112*a* and 112*b* at a contact point 108, where the curved corners 116*a* and 116*b* are formed, as the retention mechanism 102 cannot be pulled further out of the jacket 98, due to the fact that the size restriction of the inner and outer material 98*a* and 98*b*will not allow the hood 110 to be pulled further into the self-storing pocket 124.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Although embodiments of various methods and devices are described herein in detail with reference to certain versions, it should be appreciated that other versions, methods of use, embodiments, and combinations thereof are also possible. Therefore, the spirit and scope of the appended claims should not be limited to the description of the embodiments contained herein.

Figure 13:
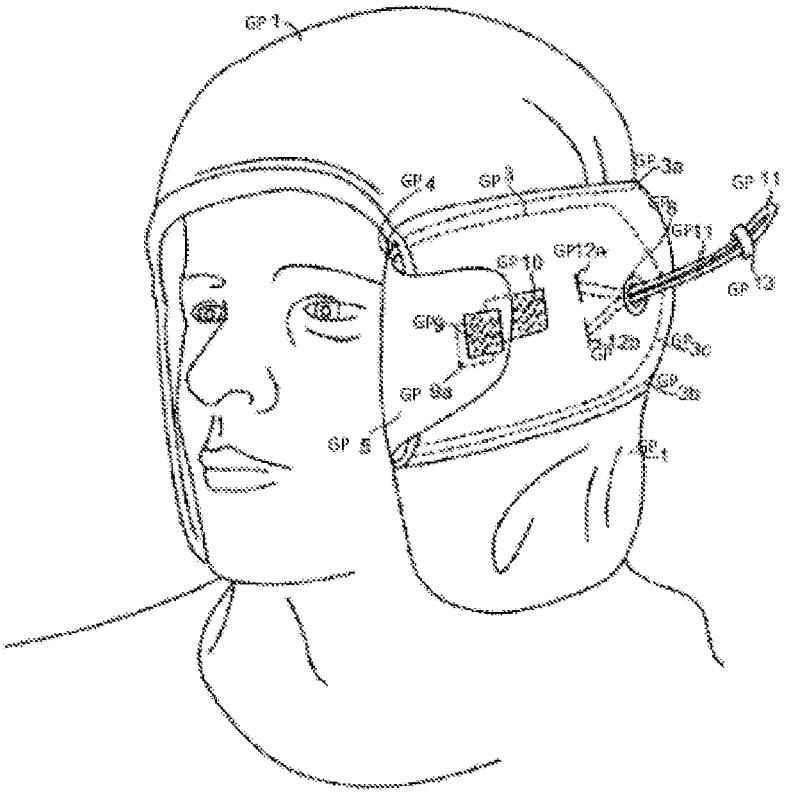
FIGS. 13-16 are side elevations illustrating a hat and goggle arrangement in accordance with a first embodiment of the invention.

Referring now to the drawings, there is shown in FIGS. 13-16 a first embodiment of the present invention as it used with an article of headwear or a hat GP1 and a goggle band GP5 (not shown in FIG. 13). A material GP3 is affixed to one side of hat GP1 as by upper and lower horizontal stitches GP3*a* and GP3*b*, which form an opening or pocket GP4. The rear edge GP3*c* of pocket GP4 may be left open or sewn closed. The material GP3 may be made of neoprene, foam, canvas, cotton, flannel, plastic, or a thermoformed plastic. A male Velcro® (hook and loop fabric) tab GP10 is placed on the outer surface of the material GP3 toward the front of the wearer's face. A pocket GP4 may be situated in a horizontal position, or it may be angled upward toward the top of the head or downward toward the wearer's neck. The pocket may also be located toward the rear of the hat or situated on the inside of the hat, or positioned in between an internal and external lining of a dual-layered hat.

Figure 14:
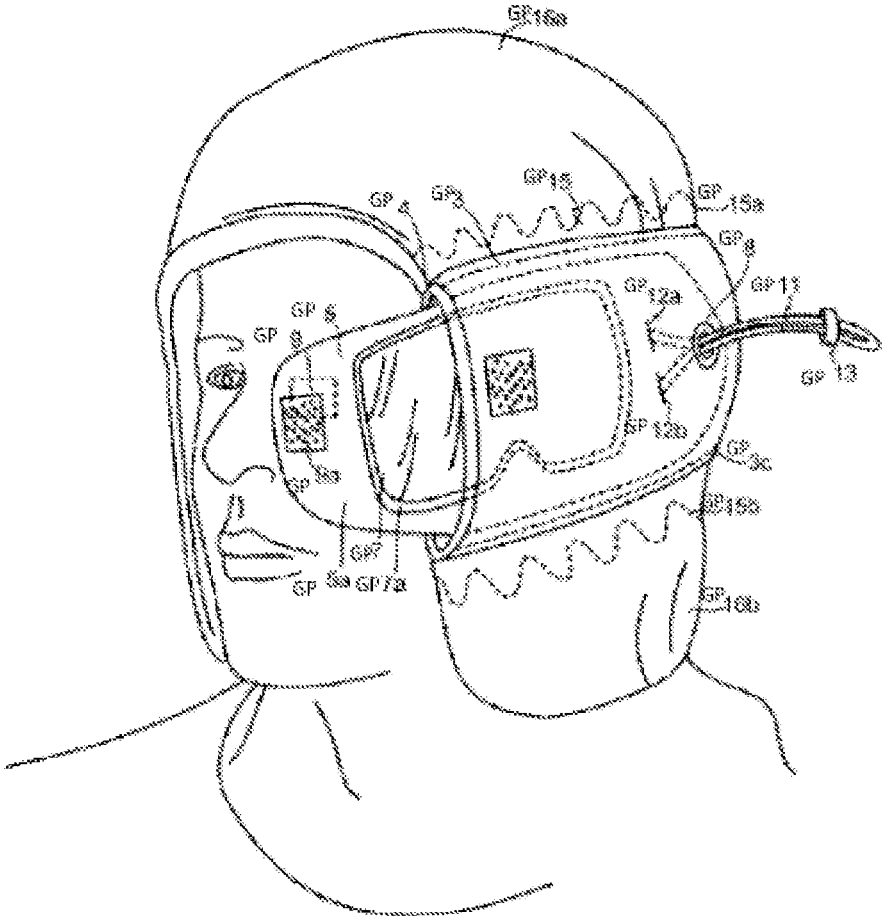

As can be seen in FIG. 14, the goggle band GP5 is normally, that is, when not deployed by the wearer, stored in a pocket GP4. A retention string GP11 is attached to the inner end of the goggle band GP5 at a contact point GP12*a*. A string GP11 extends out of the pocket GP4 through a grommet GP8 on the material GP3. The string GP11 then passes through a chord lock GP13, makes a loop, passes back through the chord lock GP13, reenters the pocket GP4 through a grommet GP8, and is reattached to the inner end of the goggle band GP5 at a contact point GP12*b*.

The other, free end of the goggle band GP5 protrudes out from the pocket GP4 toward the front end of the hat and is folded back on itself and attached to the material GP3 by means of a female Velcro® (hook and loop fabric) tab GP9*a* attached to the underside of the free end of the goggle band. When the goggle band GP5 is in the position shown in FIG. 14, stored within the pocket GP4, the exposed Velcro® (hook and loop fabric) tab GP9 is not in use. Other separably detachable elements, such as a buttons and slits, hooks and loops, latches, closure mechanisms, button snaps, snap grommets, or magnets with metal connecting tabs may be used in place of the Velcro® (hook and loop fabric) tabs GP9, GP9*a*.

When the wearer wishes to cover his eyes with the goggle, such as a skier about to descend a slope, he grabs the free end of goggle band GP5 with one hand, thereby separating the Velcro® (hook and loop fabric) tab GP9*a* from the Velcro® (hook and loop fabric) tab GP10 and allowing him to pull the goggle band GP5 out of his pocket GP4. As the wearer continues to pull the goggle band GP5 out of the pocket, the goggle band unfolds so that it comes to rest partially in front of the wearer's face, exposing the most forward position of goggle lens GP7, which is embedded into the goggle band by means of a plastic or rubber encasement GP7*a*.

Figure 15:
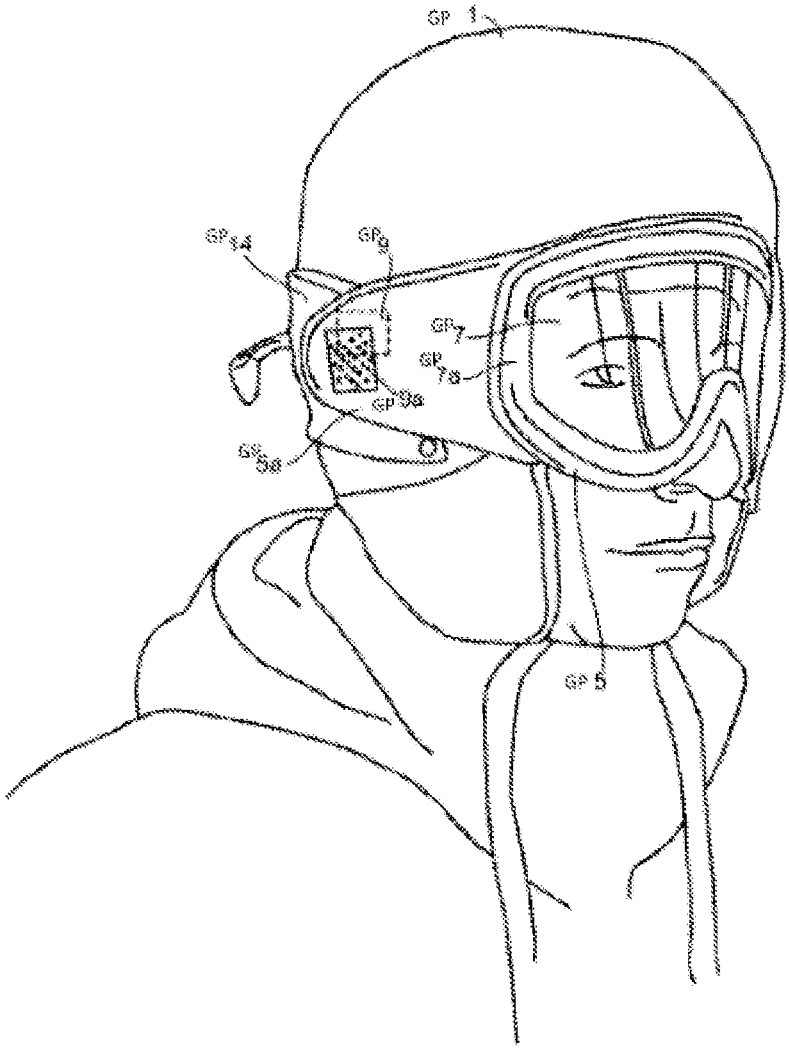

The wearer proceeds by continuing to pull the free end GP5*a* of the goggle band GP5 outward and away from his face, and then wraps it horizontally across his face and attaches its free end to the opposite side of the hat, as is shown best in FIG. 15. The free end of the goggle band is separably or detachably secured to the opposite side of the hat GP1 by means of a male Velcro® (hook and loop fabric) tab GP9 attached to the underside of the goggle band GP5 mating with the female Velcro® (hook and loop fabric) tab GP14 affixed to the opposite side of the hat. If the wearer desires a tighter fit of the goggle band, he may place the Velcro® (hook and loop fabric) tab GP9 further to the rear of the Velcro® (hook and loop fabric) tab GP14. If he desires a looser fit of the goggle band, he may position the Velcro® (hook and loop fabric) tab GP9 at a more forward position relative to the tab GP14.

Figure 16:
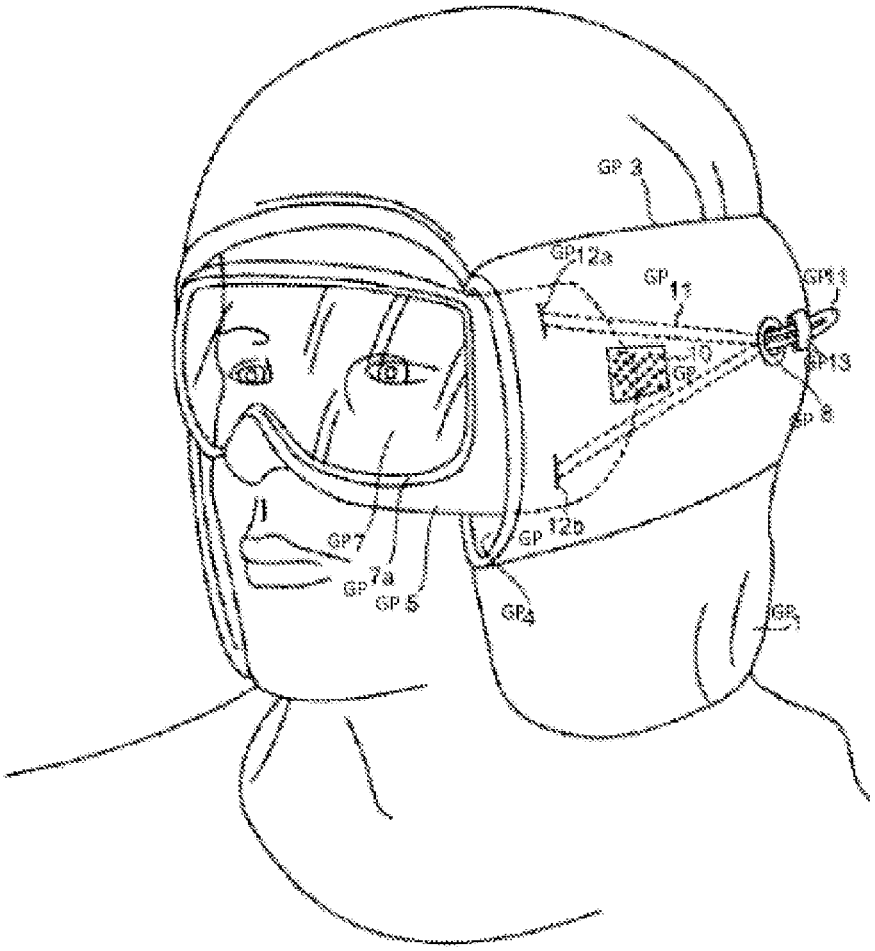

As can be seen in FIG. 16, the goggle band GP5 is fully extended across the wearer's face and is separably attached at its free end GP5*a* to the opposite side of the hat GP1. The string GP11 has been extended inwardly toward the front of the pocket GP4, and the chord lock GP13 acts as a stopper, preventing the string GP11 from being pulled any further through the grommet opening GP8, thereby preventing the goggle band GP5 from falling out of the pocket. Even in its fully extended position shown in FIG. 16, a part of the goggle band is retained within the pocket GP4.

It is also possible that the pocket GP4 and the Velcro® (hook and loop fabric) tab GP14 be separably attached to the hat GP1 by Velcro® (hook and loop fabric) or other known attaching means, If the goggle band is to be used with an open-faced helmet, the underside of the pocket GP4 and the tab GP14 may be coated with an adhesive. The wearer would peel off a protective backing and place the pocket and the Velcro® (hook and loop fabric) tab on the outer surface of the helmet.

If the wearer desires a yet tighter fit of the goggle band over his face, he may squeeze the chord lock GP13 and pull the string GP11 through the chord lock GP13, back and away from his head, thereby pulling the goggle band tighter around his face. Alternatively, the wearer may squeeze the chord lock GP13 while pulling the goggle band GP5 further out of the pocket GP4, which then pulls the string GP11 further into the pocket GP4, thereby allowing for additional slack in the string, which, in turn, results in a looser fit of the goggle band around the wearer's face.

To return the goggle band GP5 to its original, stored position shown in FIG. 13, the wearer grabs the free end GP5*a* of the goggle band GP5 with one hand, and detaches the Velcro® (hook and loop fabric) tab GP9 from the Velcro® (hook and loop fabric) tab GP14. He then, with his other hand, grabs hold of the string GP11 by the slack that is left outside of the chord lock GP13, and then pulls the retention string GP11 out and away from his head, thereby threading the string GP11 outside of the pocket GP4 through the grommet hole GP8, which reactively causes the goggle band GP5 to be retracted into the pocket GP4 to its original rest position. The wearer then grabs hold of the free end GP5*a* and folds it back over the pocket GP4, reconnecting it to the Velcro® (hook and loop fabric) tab GP10 by means of the Velcro® (hook and loop fabric) tab GP9*a*.

The wearer may either squeeze the chord lock GP13 and the thread retention string GP11 through it, as he pulls the string GP11 out and away from his head, or he may leave the chord lock GP13 in position and pull the string GP11 out and away from his head, thereby pulling the chord lock GP13 away from his head. If the latter is chosen, when the goggle band GP5 is back in pocket GP4, the wearer may squeeze the chord lock GP13, and, while holding the string GP11, slide the chord lock GP13 closer to the material GP3. It is also possible that the excess slack of the string GP11 protruding out of the pocket GP4 may be stored in a built-in pocket. It is also possible to loop a Velcro® (hook and loop fabric) tab around the string GP11, and then wrap the string around the wearer's head, and separably attach it to a Velcro® (hook and loop fabric) tab GP14 on the opposite side of the hat.

As shown in FIG. 14, the lines GP15*a* and GP15*b* define a non-permeable layer GP15 on the same side of the hat GP1 on which the pocket GP4 and the material GP3 are located. A non-permeable layer GP15 is formed of a material that is non-permeable to fluids such as plastic, nylon or rubber that does not permit water or moisture to freely pass therethrough. When the lens GP7 of the goggle band GP5 is in its stored or resting position within the pocket GP4, and the wearer begins to sweat during physical activity, the perspiration leaving the wearer's forehead that passes into the hat is prevented by the non-permeable layer GP15 from reaching the adjacent interior surface of the lens GP7 so that the lens is not fogged over, thereby allowing the wearer to have a clearer, unobstructed view through the lens when it is positioned over his face.

The areas GP16*a*, GP16*b* of hat GP1 are preferably made of a breathable material such as Gore-Tex® (waterproof, breathable fabric membrane), cotton, or Primaloft® (synthetic microfiber thermal insulation material), which does allow the passage therethrough of moisture and heat. By ventilating the areas GP16*a* and GP16*b* and by not ventilating the non-permeable area GP15, the wearer's head is allowed to breathe and to expel moisture through the areas GP16*a* and GP16*b* but not through the non-permeable layer. The non-permeable layer GP15 may be sewn or attached by Velcro® (hook and loop fabric) tabs to the interior or exterior of the hat or may be secured to the hat by latches or hooks. The non-permeable layer may also be sewn in between an internal lining and an external lining of a dual-layered hat. The non-permeable layer may also be in the form of a sprayed sealant or sprayed rubber material. This layer may also be formed by dipping the hat material into a liquid rubber, which, after drying, coats the hat and creates a non-permeable layer.

Figure 17:
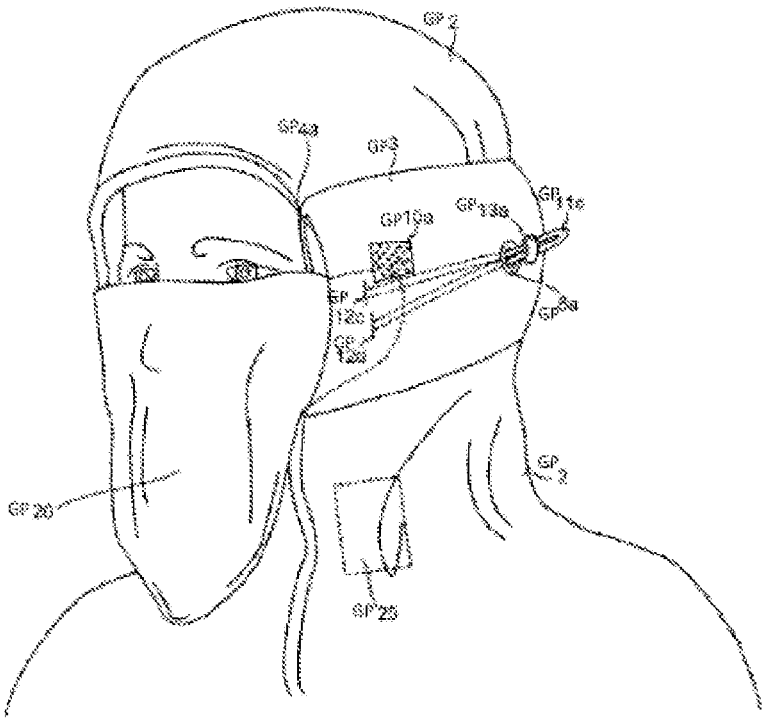
FIG. 17 illustrates a second embodiment of the invention as used in a hooded sweatshirt in which a bandanna is employed as an accessory.

The embodiment of the invention shown in FIG. 17 is similar to that shown in FIGS. 13-16 except that in place of a goggle band, a bandanna or scarf GP20 is the accessory that is used in combination with a hood GP2, which takes the place of the hat in the previously described embodiment. The size and shape of the bandanna are selected so that when it is deployed over the wearer's face, as seen in FIG. 17, it covers the wearer's nose, mouth, and cheeks.

A retention string GP11*c* is fully extended within the pocket GP4*a* formed at one side of the hood GP2 so that the chord lock GP13*a* prevents the bandanna GP20 from falling out of the pocket. Although not shown in FIG. 17, it will be understood that the free end of the bandanna is separably secured to the (unseen) opposite side of the hood by means of a Velcro® (hook and loop fabric) tab arrangement in manner that is similar to that described above in FIG. 15 for the goggle band. By tightening and loosening the chord lock GP13*a*, the fit and snugness of the bandanna can be adjusted by the wearer, also as previously described.

As also shown in FIG. 17, a female Velcro® (hook and loop fabric) tab GP25 is attached to the internal side of hood GP2. On the other side of the hood in relatively the same position, an internal male Velcro® (hook and loop fabric) tab (not shown) mates with the Velcro® (hook and loop fabric) tab GP25 to achieve a tighter fit of the hood GP2 around the neck. If desired, two pockets—one housing a goggle band and the other housing a bandanna may be provided either on one side or on opposite sides of the hood, so that both of these accessories may be deployed at the same time.

Figure 18:
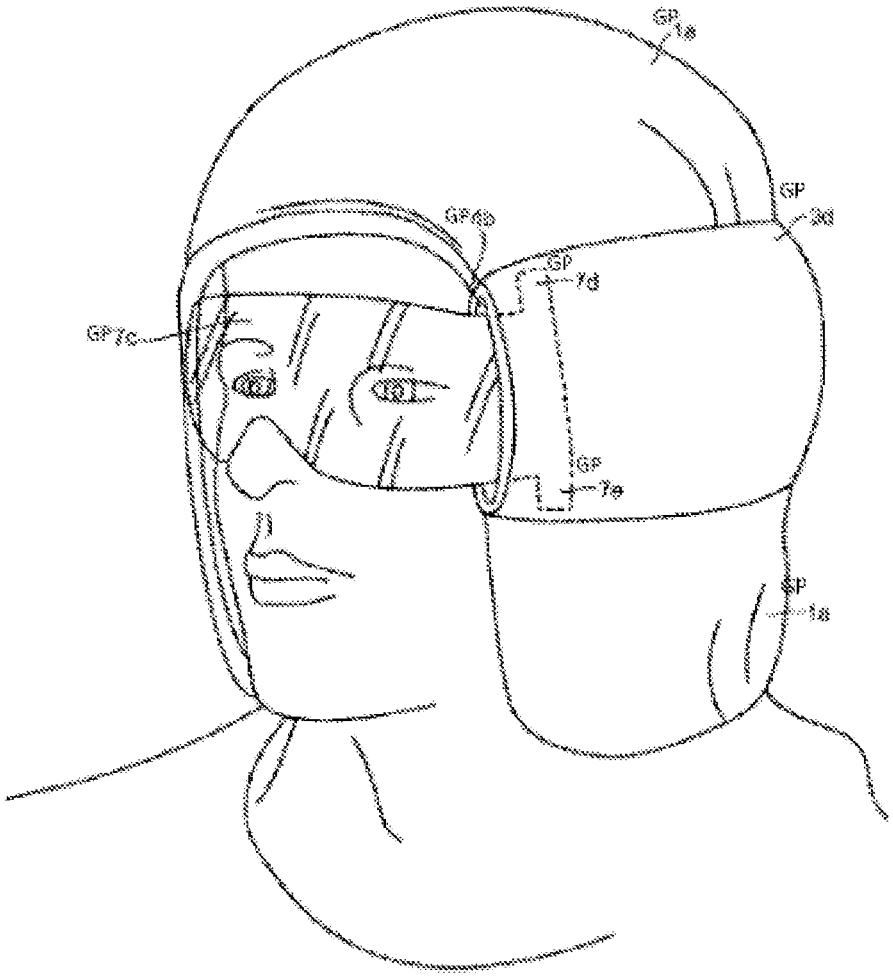
FIG. 18 illustrates a further embodiment of the invention.

In the embodiment of the invention illustrated in FIG. 18, a lens GP7*c* covers the wearer's face when in use. The lens GP7*c* is separably attached to the opposite side of the hat GP1*a* by means of a Velcro® (hook and loop fabric) connection (not shown in FIG. 18). The lens 7*c* passes through a forward opening of pocket GP4*b*, which is created by the material GP3*d* attached to the side of the hat. When not deployed over the wearer's face, the lens GP7*c* is retained in place within the pocket GP4*b* by means of the extended lens tabs GP7*d* and GP7*e* secured to the inner end of the lens. The tabs GP7*d* and GP7*e* prevent the lens from sliding out of the pocket by engaging the material GP3*d* at the opening GP4*b* because the size of the opening GP4*b* is less than height of the inner portion of the lens GP7*c* , caused by the tabs GP7*d* and GP7*e* extending upward and downward from the inner portion of the lens. The tabs GP7*d* and GP7*e* thus play the same retention function performed by the retention string GP11 in the embodiment of FIGS. 13-16.

When the wearer wishes to end the use of the protective lens GP7*c*, he manually releases the lens from the Velcro® (hook and loop fabric) tab GP14 and manually pushes it back into the storage pocket. The lens GP7*c* is adjustable at this point, at which it connects to the Velcro® (hook and loop fabric) tab GP14 at the opposite side of the hat. An adjusting device may also be added to the material GP3*d* or the pocket GP4*b* or to the allowed extension area of the lens GP7*c*, such as by the use of buttons or other types of closure devices on the interior of the material GP3*d*that would be attached to the outer surface of the hat, inside and toward the front of the pocket GP4*b*. To close these connecting points would allow a shorter length of the lens to be released from the pocket, thereby allowing the lens to fit snugly over the face of a smaller person.

Figure 19:
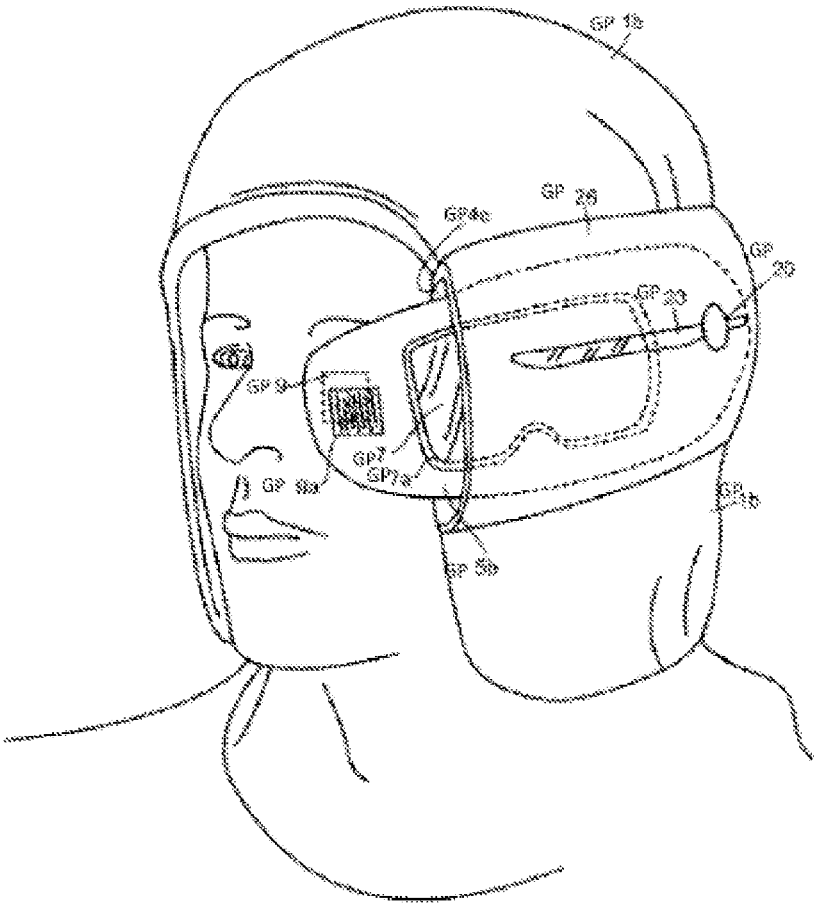
FIG. 19 illustrates another embodiment of the invention.

In the embodiment of the invention shown in FIG. 19, an encasement GP26 made of plastic, neoprene, or thermoformed plastic is attached to the outer surface of the hat to create a pocket GP4*c* in which a lens or goggle band GP5*b* is stored. The encasement GP26 is preferably convex in shape. A goggle band GP5*b* is attached to hat GP1*b* by a knob GP20, which is inserted through a slit or track GP23 to an encasement GP26. A track GP23 allows the goggle band to slide horizontally front to back in the pocket GP4*c*.

In use, the wearer grasps the goggle band GP5*b* at its free end, pulls it across his face, and attaches it to the opposite side of the hat, as in the previously described embodiments. As this happens, the knob GP20 slides toward the front of pocket GP4*c* toward the wearer's eyes along the track GP23. Further inward motion of the knob GP20 is prevented when the knob reaches its most forward position on the track GP23, which prevents the goggle band from falling out of the pocket. To retract the goggle band GP5*b* into the pocket, after use, the wearer first detaches the goggle band free end GP5*c* from its separable attachment at the opposite side of the hat, and then takes hold of the knob GP20 with his other hand to slide the knob along the track GP23 back to its rearmost position in the pocket GP4*c*, which causes the goggle band to be pulled into its stored position within the pocket GP4*c*.

Figure 20:
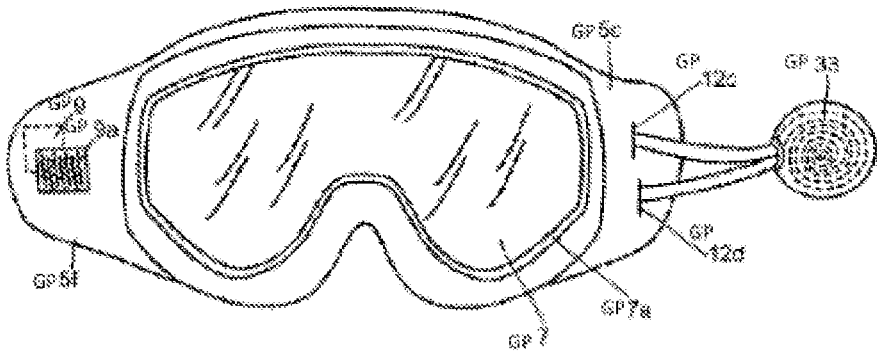
FIG. 20 illustrates an additional embodiment of the invention.

In the embodiment of the invention shown in FIG. 20, a retention mechanism or wire GP11 *a* begins at a point GP12*c* on the goggle band GP5*c* and passes through a spring-loaded pull and reel mechanism GP33. A wire GP11*a* then passes out of a reel mechanism GP33 and reconnects to the goggle band GP5*c* at a point GP12*d*. The goggle band may also be used in any of the previously described embodiments by attaching a reel mechanism GP33 to the inside of the storage pocket. In use of the FIG. 20 embodiment, the wearer grabs area GP5*f* of the goggle band GP5*c* and pulls it across his face to the opposite side of the hat. As this is occurring, the retention string GP11 *a* unwinds from the reel mechanism GP33 and extends through the pocket.

When the wearer attaches area GP5*f* to the opposite side of the hat at a Velcro® (hook and loop fabric) tab GP14, the reel mechanism GP33 locks into place and maintains the extended length of the string GP11 at a constant length. When the wearer no longer wishes the goggle band to be positioned over his eyes, he detaches area GP5*f* from the Velcro® (hook and loop fabric) tab GP14 and pulls area GP5*f* out and away from the reel mechanism GP33, thereby releasing the locking mechanism. The wearer then releases his hold on area GP5*f*, which causes the reel mechanism GP33 to automatically recoil and to rewind the retention string GP11*a* back into the reel mechanism GP33, thereby pulling the goggle band back into the storage pocket.

Figure 21:
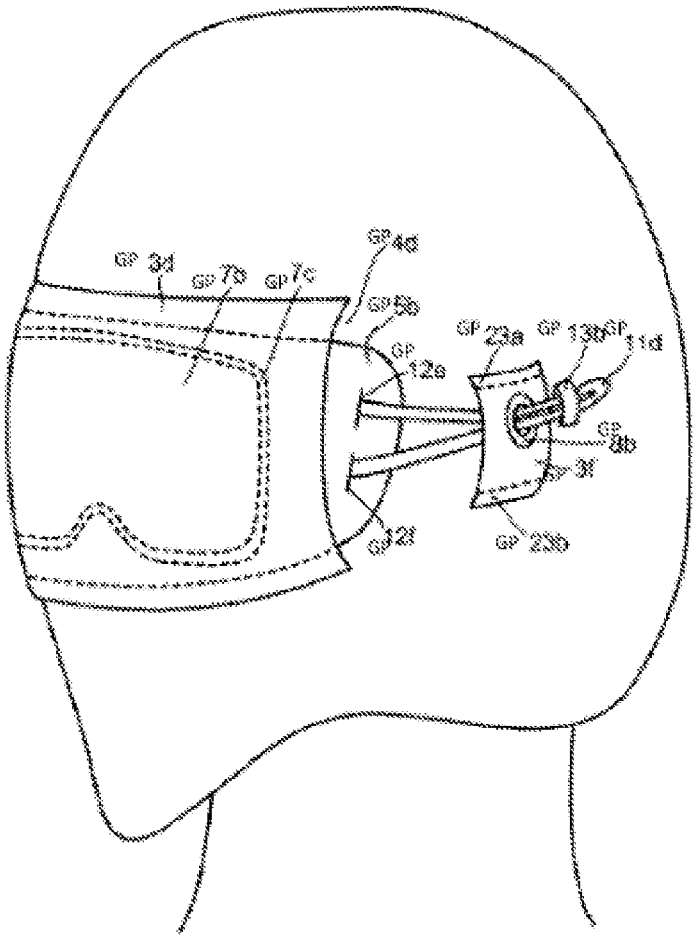
FIG. 21 illustrates yet another embodiment of the invention.

FIG. 21 shows an alternate embodiment to that shown in FIG. 13, with the hat being viewed from the rear. A pocket GP4*b* houses the goggle band GP5*b* by means of the material GP3*d* attached to the hat GP3. The goggle band GP5*b* protrudes out of the pocket GP4*d* at the opening at its rear. A string GP11*d*, attached to the goggle band GP5*b* at a point GP12*e*, passes through a grommet GP8*b* on a separate fabric tab GP3*f*. The fabric tab GP3*f* is sewn to the hat GP3 by an upper stitch GP23*a* and a lower stitch GP23*b*. The string GP11*d* then passes through the chord lock GP13*b*, loops back around passing through the chord lock GP13*b*, then through a grommet GP8*b*, and is reattached to the goggle band GP5*b* at a point GP12*f*. By positioning the external tab GP3*f* at a location further to the rear of the hat GP3, the wearer is allowed more leverage when he pulls the goggle band GP5*b* back into the pocket GP4*b* by means of the string GP11*d*. The position of the tab GP3*f* allows the goggle band GP5*d* to be pulled further back into the pocket GP4*d*.

As an alternative to the string GP11*d*, the goggle band GP5*b* may extend through the pocket GP4*d* to its rear in the form of a material band, which then may pass through a plastic ring or a loop that would be used in place of the grommet GP8*b*. The excess, extended material from the goggle band GP5*b* would pass through this loop, change direction toward the front of the hat and be separably be attached by means of a Velcro® (hook and loop fabric) tab, for example, to a designated area at the rear of the pocket. Excess material from the goggle band GP5*b* would pass through the loop and then through any known adjustable guiding mechanism. This arrangement allows for the lengthening or shortening of the excess material of the goggle band GP5*b*, thus allowing for an adjustable fit of the goggle band over the wearer's eyes. Excess, extended material from the goggle band GP5*b* or from the string GP11*d* may also pass out of the pocket GP4*d* at a slit or opening on the surface of the material GP3*d* at the rear of the pocket GP4*d*.

It is also possible to incorporate the reel mechanism GP33 into the embodiment of FIG. 21, in which the reel mechanism would be placed between the tab GP3*f* and the pocket GP4*b*—either attached to the hat GP3, or be left to hang loose. A string GP11*d*, beginning at a point GP12*e*, would pass out of the pocket GP4*b*, then through a reel mechanism GP33, through a grommet GP8*b* of a tab GP3*f* and then through a chord lock GP13*b*, where it loops around and passes back through the grommet GP8*b*, through the reel mechanism GP33, and is reattached to the goggle band GP5*b* at a point GP12*f*. The reel mechanism GP33 may also be positioned externally to tab GP3*f* in a similar manner.

It will be understood that although the present invention has been hereinabove described with respect to several embodiments thereof, modifications may be made therein and thereto without necessarily departing from the spirit and scope of the invention as defined in the appended claims.

What is claimed is:

1. A headwear assembly, comprising:

a body portion, that when worn, has a storage region that is located proximate to one side of the wearer's face and an extension portion configured to extend from an interior portion of the storage region across the wearer's face to partially cover the wearer's face and configurable to be secured on a portion of the body on the opposite side of the storage region;

the extension portion having a stored position and an open position, wherein, in the stored position, the extension portion is positioned in the interior portion of the storage region, and wherein in transitioning from the stored position to the open position, the extension portion extends laterally from the interior portion of the storage region across the wearer's face when worn;

a retention mechanism secured to the extension portion, the retention mechanism extending from the extension portion and protruding from the storage region and extending through a part of the body portion, wherein at least a portion of the retention mechanism protruding through the part of the body portion pulls the extension portion from the open position to the stored position to store the extension portion within interior portion of the storage region.

2. The headwear assembly according to claim 1, wherein the retention mechanism includes at least one of the following: a chord, a reel mechanism, a slit, a track, a knob, and separably detachable elements, such as a button, hooks and loops, latches, closure mechanisms, button snaps, snap grommets, and magnets with metal connecting tabs.

3. The headwear assembly according to claim 1, wherein the retention mechanism includes at least one of the following: a string, a plurality of strings, one or more strings with a locking mechanism, a strap, a band, and any combination thereof.

4. The headwear assembly according to claim 1, wherein the extension portion includes at least one of the following: a mask, a face mask, a ski mask, a surgical mask, a utility mask, eyeglasses, goggles, and any combination thereof.

5. The headwear assembly according to claim 1, wherein the headwear assembly includes at least one of the following: a hood, a hat, a winter hat, a hood attached to a jacket or a shirt, a helmet, a cap, a headwear accessory, a medical head covering, a head covering, a medical cap, and any combination thereof.

6. The headwear assembly according to claim 1, wherein the retention mechanism is attached to the extension portion.

7. The headwear assembly according to claim 1, further comprising an opening in the body portion disposed proximately to the storage region; and at least a portion of the retention mechanism protruding through the opening in the body portion.

8. The headwear assembly according to claim 1, wherein the extension portion is stored in a folded configuration in the storage region.

9. The headwear assembly according to claim 8, wherein the retention mechanism is attached to the extension portion, wherein upon pulling the extension portion from the open position to the stored position, the extension portion is folded by the retention mechanism into the folded configuration.

10. The headwear assembly according to claim 1, wherein the extension portion has a first side and a second side disposed opposite the first side, wherein the retention mechanism is coupled to the first or second side of the extension portion; and the second side of the extension portion is coupled to a portion of the headwear assembly disposed opposite the storage region when the extension portion is in the open position.

11. The headwear assembly according to claim 1, further comprising a locking mechanism movably coupled to the retention mechanism to perform at least one of the following: restrict movement of the retention mechanism, prevent removal of the extension portion from the storage region, and any combination thereof.

12. The headwear assembly according to claim 1, wherein the storage region is attached to at least one of the following: an exterior of the body portion and an interior of the body portion.

13. The headwear assembly according to claim 1, wherein the storage region is incorporated into a wall of the body portion.

14. The headwear assembly of claim 1, further comprising a securing mechanism located on the body portion on the opposite side of the wearer's face relative to the storage region.

15. The headwear assembly of claim 14, wherein the extension portion of the headwear assembly also has a securing mechanism to couple or mate with the securing mechanism located on the body portion on the opposite side relative to the storage region.

16. The headwear assembly of claim 6, wherein the retention mechanism is adjustable to ensure an optimal fit of the extension portion across the wearer's face in the open position when is worn.

* * * * *